US012781719B2

(12) United States Patent
Yao et al.

(10) Patent No.: US 12,781,719 B2
(45) Date of Patent: Nov. 3, 2026

(54) SPLIT-TYPE PLUNGER PUMP AND SPLIT-TYPE PLUNGER PUMP COMPONENT

(71) Applicant: YANTAI JEREH OILFIELD SERVICES GROUP CO., LTD., Yantai (CN)

(72) Inventors: Junlei Yao, Yantai (CN); Maoqin Li, Yantai (CN); Xueqing Gao, Yantai (CN); Qianjie Li, Yantai (CN); Feng Wang, Yantai (CN)

(73) Assignee: Yantai Jereh Oilfield Services Group Co., Ltd., Yantai (CN)

( * ) Notice: Subject to any disclaimer, the term of this patent is extended or adjusted under 35 U.S.C. 154(b) by 0 days.

(21) Appl. No.: 19/213,707

(22) Filed: May 20, 2025

(65) Prior Publication Data

US 2025/0369429 A1 Dec. 4, 2025

Related U.S. Application Data

(63) Continuation of application No. PCT/CN2024/132290, filed on Nov. 15, 2024.

(30) Foreign Application Priority Data

May 28, 2024 (CN) ..... 202410674637.2

(51) Int. Cl.
*F04B 9/02* (2006.01)
*F04B 1/04* (2020.01)
(Continued)

(52) U.S. Cl.
CPC ..... *F04B 9/02* (2013.01); *F04B 1/04* (2013.01); *F04B 1/0404* (2013.01);
(Continued)

(58) Field of Classification Search
CPC .. F04B 9/02; F04B 1/04; F04B 1/0404; F04B 1/0439; F04B 53/16; F04B 53/22; F04B 15/02; E21B 43/2607
See application file for complete search history.

(56) References Cited

U.S. PATENT DOCUMENTS 5,676,528 A * 10/1997 Kobayashi ..... F04D 15/0072 417/247
2012/0167759 A1 7/2012 Chinthan et al.
(Continued)

FOREIGN PATENT DOCUMENTS

CN 105545622 A 5/2016
CN 109869294 A 6/2019
(Continued)

OTHER PUBLICATIONS

International Search Report (PCT/ISA/210) issued in PCT Application No. PCT/CN2024/132290 dated Feb. 13, 2025 with English translation (7 pages).
(Continued)

*Primary Examiner* — Charles G Freay
(74) *Attorney, Agent, or Firm* — Crowell & Moring LLP

(57) ABSTRACT

A split-type plunger pump includes: a first module including a reduction gearbox assembly, an input side interface thereof being connected to a power source; a second module including a crankcase assembly, an input side interface thereof being connected to an output side interface of the first module; a third module including a crosshead box assembly, an input side interface thereof being connected to an output side interface of the second module; and a fourth module including a fluid end assembly, an input side interface thereof being connected to an output side interface of the third module. The reduction gearbox assembly, the crank-
(Continued)

case assembly, the crosshead box assembly, and the fluid end assembly are sequentially connected.

20 Claims, 26 Drawing Sheets

(51) Int. Cl.

| | |
|---|---|
| ***F04B 1/0404*** | (2020.01) |
| ***F04B 1/0439*** | (2020.01) |
| ***F04B 53/16*** | (2006.01) |
| ***F04B 53/22*** | (2006.01) |
| *E21B 43/26* | (2006.01) |
| *F04B 15/02* | (2006.01) |

(52) U.S. Cl.
CPC ..... *F04B 1/0439* (2013.01); *F04B 53/16* (2013.01); *F04B 53/22* (2013.01); *E21B 43/2607* (2020.05); *F04B 15/02* (2013.01)

(56) References Cited

U.S. PATENT DOCUMENTS

| | | | | |
|---|---|---|---|---|
| 2016/0025090 | A1* | 1/2016 | Bayyouk | F04B 53/16 92/161 |
| 2020/0332788 | A1 | 10/2020 | Cui et al. | |
| 2020/0386221 | A1* | 12/2020 | Pham | F04B 53/14 |
| 2021/0087943 | A1* | 3/2021 | Cui | F04B 1/0439 |
| 2021/0123425 | A1* | 4/2021 | Cui | F04B 39/128 |
| 2022/0106951 | A1* | 4/2022 | Foster | F04B 15/02 |
| 2025/0250974 | A1* | 8/2025 | Keith | F04B 53/164 |
| 2025/0369429 | A1 | 12/2025 | Yao et al. | |

FOREIGN PATENT DOCUMENTS

| | | | |
|---|---|---|---|
| CN | 110486249 | A | 11/2019 |
| CN | 116733705 | A | 9/2023 |
| CN | 116877417 | A | 10/2023 |
| CN | 116892508 | A | 10/2023 |
| CN | 116988963 | A | 11/2023 |
| CN | 118423269 | A | 8/2024 |

OTHER PUBLICATIONS

Chinese-language Written Opinion (PCT/ISA/237) issued in PCT Application No. PCT/CN2024/132290 dated Feb. 13, 2025 with English translation (7 pages).

* cited by examiner

SPLIT-TYPE PLUNGER PUMP AND SPLIT-TYPE PLUNGER PUMP COMPONENT

CROSS-REFERENCE TO RELATED APPLICATIONS

This application is based on and claims the benefit of priority to PCT International Patent Application No. PCT/CN2024/132290, filed on Nov. 15, 2024, which is based on and claims the benefit of priority to Chinese Patent Application No. 202410674637.2, filed on May 28, 2024, each of which are hereby fully incorporated by reference in their entirety.

TECHNICAL FIELD

The present disclosure relates to a split-type plunger pump and a split-type plunger pump component.

BACKGROUND

In recent years, operations of fracturing equipment have been evolving toward higher displacement and greater pressure. To meet demands for larger-scale operations, the number of equipment in fracturing equipment operation fleets can be increased. However, this also brings higher requirements in terms of personnel, materials, occupied area, pipeline connections, and the management capabilities for equipment and materials, which significantly increases operational costs. Therefore, a more widely accepted improvement direction in the industry is to use higher-power plunger pumps in fracturing equipment, thereby increasing power density per unit. In addition, due to a large size and a heavy weight of internal combustion engines, such as fuel (e.g., diesel) engines, gas (e.g., natural gas (NG), manufactured gas (MG), liquefied petroleum gas (LPG), methane, etc.) engines, and dual-fuel engines (i.e., engines using both fuel and gas as fuels), engines often can only drive plunger pumps with rated power below 2500 hp. To solve this problem, there has been a trend in fracturing equipment toward replacing engines with electric motors as a prime mover (power source). Even plunger pumps with rated power of up to 7000 hp can be driven by using electric motors.

Main performance parameters of plunger pumps include maximum displacement and maximum working pressure, and these performance parameters depend on structural parameters such as a plunger diameter, a plunger stroke, a maximum connecting rod load, and a reduction gearbox gear ratio. For users, it would be ideal if the performance parameters of plunger pumps could adapt to their specific operational or equipment configuration requirements.

However, on the one hand, for example, for different stroke requirements, components of an existing plunger pump's fluid end assembly and power end assembly (crosshead box, crankcase, and reduction gearbox) have different designs in terms of sizes of various parts (such as crosshead slideways, connecting rods, crankshafts, and crankshaft bearings), which results in differing housing sizes for these components, and consequently, positions of external interfaces on housings are also different. On the other hand, external interface design manners of the components of the existing plunger pump and the housing thereof also have different specifications. Because a housing size, the positions of the external interfaces, and the design manners of the external interfaces cannot be altered, the components cannot be directly replaced with other components with different specifications individually. Possible impact of the foregoing problems on actual applications includes:

(1) When users require the fracturing equipment to be adaptable to different working conditions and thus need to change the stroke of the plunger pump, it is not possible to achieve this by individually replacing components such as a crankshaft, a connecting rod, and a pull rod while keeping a power end housing structure unchanged, but the entire plunger pump needs to be replaced.

(2) When users want to switch the fracturing equipment from being driven by a diesel engine (diesel drive) to being driven by an electric motor (electric drive), because the electric motor is usually connected directly to the plunger pump via a transmission shaft, unlike the diesel drive where a gearbox is provided to achieve speed reduction and torque increasing, an input rotational speed provided by the electric motor to the plunger pump will be higher. In this case, in order to maintain an operating rotational speed of the crankshaft of the plunger pump, it is required that the reduction gearbox of the plunger pump be changed to have a higher gear ratio. However, due to limitations by a reduction gearbox housing size, sizes and mounting positions of gears cannot be adjusted in a reducing mechanism, and thus the entire plunger pump needs to be replaced.

(3) An output shaft position of the electric motor is usually higher than that of an output shaft position of the fuel engine. When adapting to different prime movers, because a position of a connection flange of an assembly of the plunger pump for connecting to the prime mover cannot be adjusted, it is necessary to adjust positioning of the plunger pump by replacing a base height, an inlet pipe assembly, an outlet pipe assembly, and other external connection systems, or it is necessary to replace the entire plunger pump with an adaptable model.

In the aforementioned scenarios, replacing the entire plunger pump not only incurs high costs but also results in significant workload for connecting mating components and configuring parameters, as mounting positions and external pipeline interface positions of different models of plunger pumps are different.

According to another common structure of plunger pumps available on the market, a power end assembly and a reduction gearbox thereof are two separate parts. However, the reduction gearbox has different design specifications for different prime movers, and aspects such as an interface of the reduction gearbox connecting to the prime mover and a position of an input shaft of the reduction gearbox relative to the crankshaft have not been standardized in design. Therefore, when replacing the prime mover, it is not only necessary to replace the corresponding reduction gearbox, but the overall positioning of the plunger pump may also need to be adjusted, which significantly impacts overall layout of the product. This prevents quick product switching and greatly wastes manpower, materials, and operation time.

In conclusion, the current expectation is to adopt a split-type design for the plunger pump and to perform platform-based and standardized design for external interfaces of each assembly. This would allow assemblies with different specifications to be quickly replaced without altering other parts, thereby making changes to performance parameters while keeping overall external connections of the plunger pump unchanged. This design would adapt to prime movers with different specifications and meet demands of different working conditions.

SUMMARY

Technical Problems to be Solved

An objective of the present disclosure is to provide a split-type plunger pump, and an external interface of each module thereof is platform-based, so that any module can be rapidly replaced with one with a different specification independently, and can adapt to power sources with different specifications.

Another objective of the present disclosure is to provide a split-type plunger pump component. Each assembly has at least one specification. For assemblies with different specifications, external interfaces are platform-based, so that components with different specifications can be combined to obtain plunger pump products with different performance parameters.

Technical Solutions to the Problems

According to a first aspect of the present disclosure, a split-type plunger pump is provided, including: a first module, including a reduction gearbox assembly, an input side interface of the first module being detachably connected to a power source; a second module, including a crankcase assembly, an input side interface of the second module being detachably connected to an output side interface of the first module; a third module, including a crosshead box assembly, an input side interface of the third module being detachably connected to an output side interface of the second module; and a fourth module, including a fluid end assembly, an input side interface of the fourth module being detachably connected to an output side interface of the third module. Herein the reduction gearbox assembly, the crankcase assembly, the crosshead box assembly, and the fluid end assembly are sequentially connected. An input shaft of the reduction gearbox assembly receives power output from a transmission shaft of the power source, and an output shaft of the reduction gearbox assembly outputs rotary power to a crankshaft of the crankcase assembly. In addition, the output side interface and/or the input side interface of the first module are configured in a platform-based manner.

According to a second aspect of the present disclosure, a split-type plunger pump component is provided, including a fluid end assembly with at least one specification; a crosshead box assembly with at least one specification; a crankcase assembly with at least one specification; and a reduction gearbox assembly with at least one specification. Herein, the fluid end assembly with any specification has a first interface, the crosshead box assembly with any specification has a second interface and a third interface, and the second interface is detachably connected to the first interface, the crankcase assembly with any specification has a fourth interface and a fifth interface, and the fourth interface is detachably connected to the third interface, the reduction gearbox assembly with any specification has a sixth interface and a seventh interface, the sixth interface is detachably connected to the fifth interface, and the seventh interface is detachably connected to a power source. The first interface to the seventh interface are configured in a platform-based manner. In addition, any two or more of the fluid end assembly, the crosshead box assembly, the crankcase assembly, and the reduction gearbox assembly are combined according to any specification to configure plunger pumps with different performance parameters.

Beneficial Effects

The split-type plunger pump of the present disclosure achieves platformization of an external interface of each assembly, allowing each assembly to be individually replaced with one with another specification within a same platform. The present disclosure achieves platformization of external interfaces of assemblies with different specifications, allowing combination of assemblies with different specifications to obtain plunger pump products with different performance parameters, thereby flexibly adapting to different application scenarios. In addition, because each assembly can be compatible with different specification changes of other assemblies via a platform-based external interface, conversion between products can also be implemented by replacing at least one assembly in a product. In addition, due to platformization of the external interface of each assembly, switching to a different power source does not require replacing the entire plunger pump or modifying surrounding auxiliary systems of the plunger pump. Instead, adaptation to changes in the power source can be achieved by adjusting mounting angles of some assemblies or replacing some assemblies.

BRIEF DESCRIPTION OF THE DRAWINGS

The accompanying drawings form a part of this specification and are used to provide a further understanding of the present disclosure. The example embodiments, alternatives, and variants of the present disclosure, along with their descriptions, are provided solely to illustrate the present disclosure and are not intended to limit the present disclosure. In the accompanying drawings.

DETAILED DESCRIPTION

The following describes the embodiments of the present disclosure in detail with reference to the accompanying drawings. Note that the descriptions are given in the following order.

1. Overview of a split-design plunger pump
   - 1.1 Overview of connections
   - 1.2 Overview of a transmission manner
2. Platform-based design of a first module
   - 2.1 Reduction gearbox assembly
   - 2.2 Connections on a crankcase assembly side of the reduction gearbox assembly
   - 2.3 Connections on a power source side of the reduction gearbox assembly
3. Platform-based design of a second module
   - 3.1 Crankcase assembly
   - 3.2 CONNECTIONS ON A REDUCTION GEARBOX ASSEMBLY SIDE OF THE CRANKCASE ASSEMBLY
   - 3.3 CONNECTIONS ON A CROSSHEAD BOX ASSEMBLY SIDE OF THE CRANKCASE ASSEMBLY
4. Platform-based design of a third module
   - 4.1 Crosshead box assembly
   - 4.2 Connections on a crankcase assembly side of the crosshead box assembly
   - 4.3 Connections on a spacer frame assembly side of the crosshead box assembly
5. Platform-based design of a fifth module
   - 5.1 SPACER FRAME ASSEMBLY
   - 5.2 CONNECTIONS ON A CROSSHEAD BOX ASSEMBLY SIDE OF THE SPACER FRAME ASSEMBLY
   - 5.3 CONNECTIONS ON A FLUID END ASSEMBLY SIDE OF THE SPACER FRAME ASSEMBLY
6. Platform-based design of a fourth module
   - 6.1 Fluid end assembly
   - 6.2 Connections on a spacer frame assembly side of the fluid end assembly
   - 6.3 Connections on other sides of the fluid end assembly
7. Different combination manners of the split-type plunger pump component
   - 7.1 Different combination manners
   - 7.2 Examples of replacement between different combination manners

[1. Overview of a Split-Design Plunger Pump]

Figure 1A:
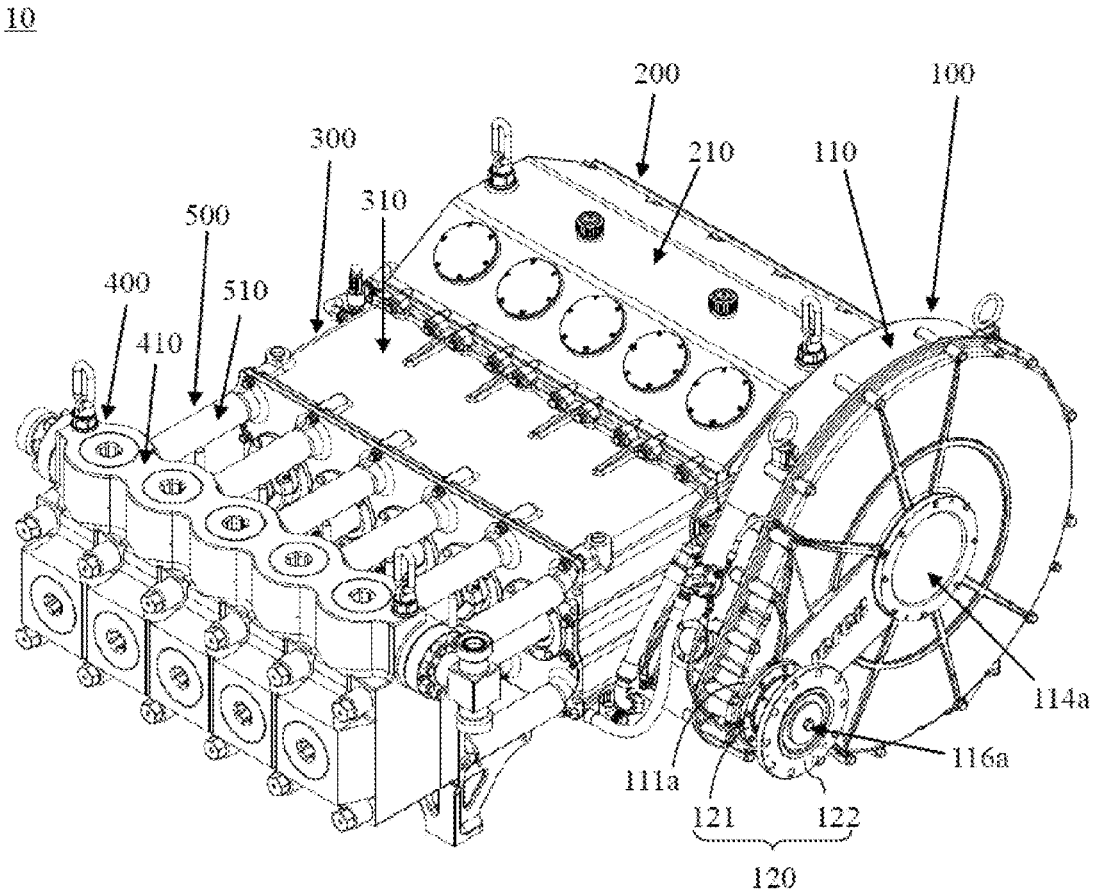
FIG. 1A, FIG. 1B, and FIG. 1C are respectively a schematic diagram, a three-dimensional view, and a top plan view of a configuration example of a split-type plunger pump according to an embodiment of the present disclosure.
Figure 1B:
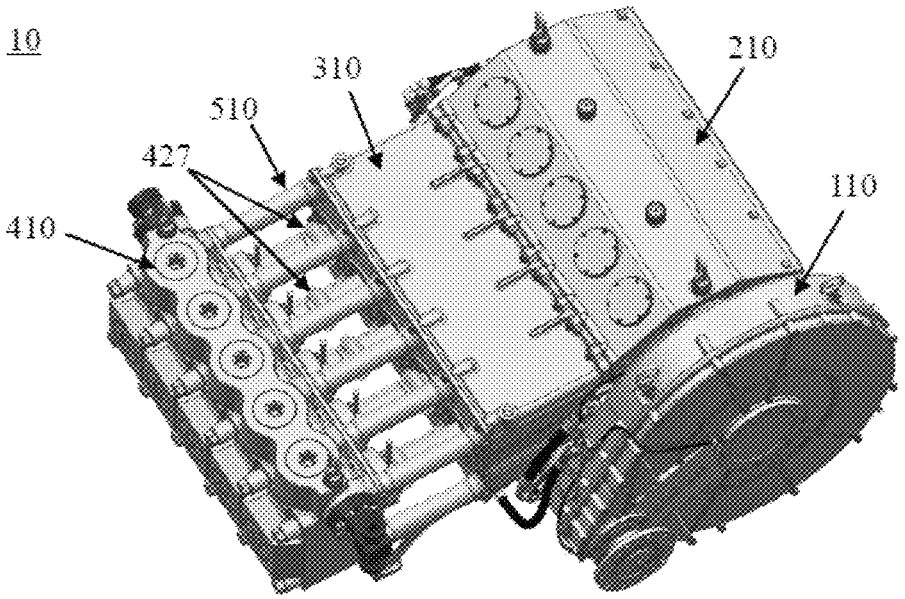
Figure 1C:
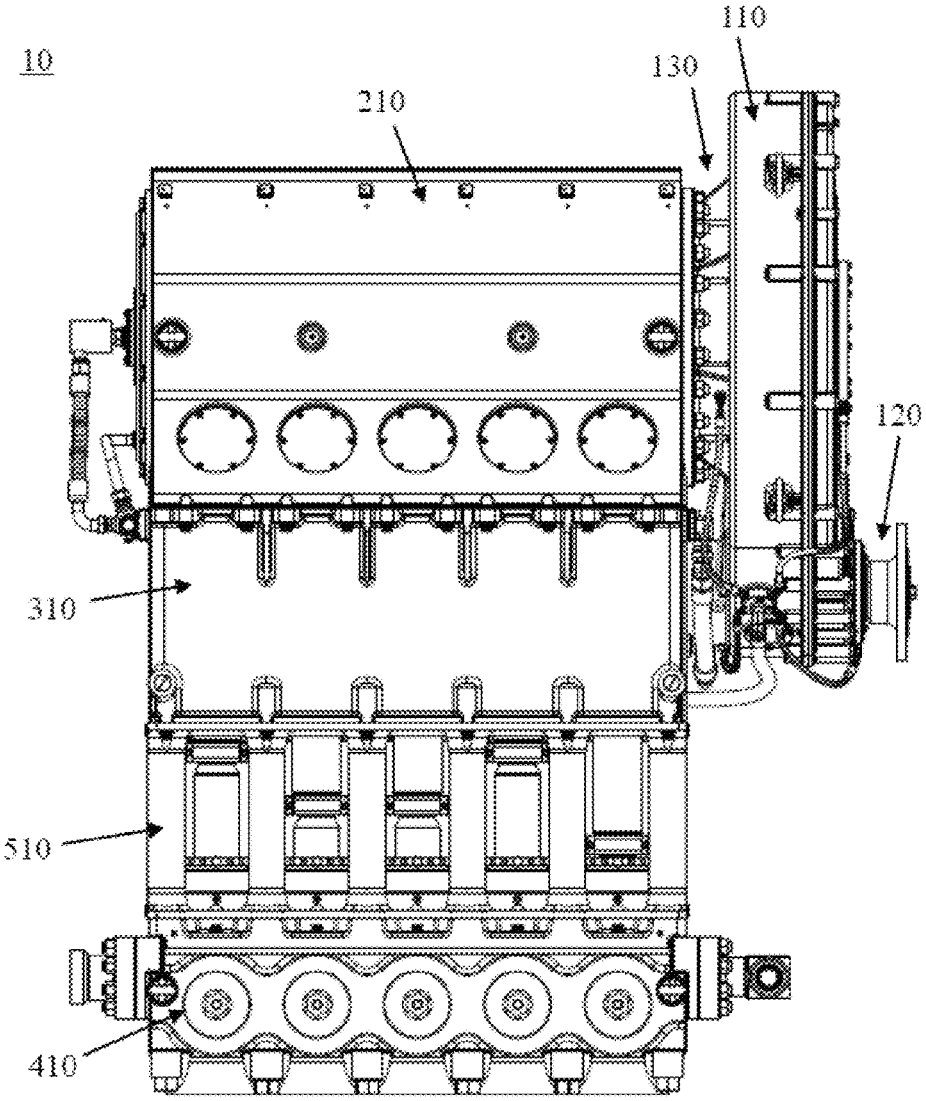

FIG. 1A, FIG. 1B, and FIG. 1C are respectively a schematic diagram, a three-dimensional view, and a top plan view of a configuration example of a split-type plunger pump according to an embodiment of the present disclosure. As shown in FIG. 1A to FIG. 1C, a split-type plunger pump 10 includes a reduction gearbox assembly 110, a crankcase assembly 210, a crosshead box assembly 310, a spacer frame assembly 510, and a fluid end assembly 410 that are sequentially connected. The crankcase assembly 210, the crosshead box assembly 310, the spacer frame assembly 510, and the fluid end assembly 410 are arranged in one arrangement direction. The reduction gearbox assembly 110 is mounted on one side of the crankcase assembly 210 in a direction perpendicular to the arrangement direction, and may extend to one side of the crosshead box assembly 310 in a direction perpendicular to the arrangement direction.

As an alternative, the spacer frame assembly 510 is not required. The crosshead box assembly 310 is directly connected to the fluid end assembly 410 in a case of omitting the spacer frame assembly 510. In the following, unless otherwise noted, the case including the spacer frame assembly 510 is mainly described as an example.

To facilitate further description of the platform-based design later, main components of the split-type plunger pump 10 are divided herein into a first module 100, a second module 200, a third module 300, a fourth module 400, and a fifth module 500. The first module 100 includes a reduction gearbox assembly 110, a connection flange 120, and a mounting flange 130. The connection flange 120 is used as an input side interface of the first module 100 to detachably connect the first module 100 to a transmission shaft of a power source (for example, refer to an engine in FIG. 7 or an electric motor in FIG. 8 described later). The mounting flange 130 is used as an output side interface of the first module 100 to detachably connect the first module 100 to the second module 200. The second module 200 includes a crankcase assembly 210, and an input port and an output port of the crankcase assembly 210 are respectively detachably connected to the first module 100 and the third module 300 respectively as an input side interface and an output side interface of the second module 200. The third module 300 includes a crosshead box assembly 310, and an input port and an output port of the crosshead box assembly 310 are respectively detachably connected to the second module 200 and the fifth module 500 respectively as an input side interface and an output side interface of the third module 300. The fifth module 500 includes a spacer frame assembly 510, and an input port and an output port of the spacer frame assembly 510 are respectively detachably connected to the third module 300 and the fourth module 400 respectively as an input side interface and an output side interface of the fifth module 500. The fourth module 400 includes a fluid end assembly 410, and a plunger side port of the fluid end assembly 410 is detachably connected to the fifth module 500 as an input side interface of the fourth module 400, and the fluid end assembly 410 further has a suction end detachably connected to an inlet pipe assembly and a discharge end detachably connected to an outlet pipe assembly.

It is generally known that the power source may be selected from any specification of an electric motor, a gas engine, a fuel engine, a dual-fuel engine, and a turbine engine. For power sources with different specifications, their drive shafts may have different height positions, resulting in different height positions of transmission shafts connected to the drive shafts. In this embodiment of the present disclosure, the first module 100 may rotate during mounting, so that a height position of the input side interface thereof can be adjusted to be aligned with height positions of transmission shafts of power sources with different specifications. In addition, in this embodiment of the present disclosure, the input side interface of the first module 100 is configured in a platform-based manner, to adapt to transmission shaft output ports of power sources with different specifications.

In addition, according to a variant of the present disclosure, when the power source is replaced with another power source with a different specification, the reduction gearbox assembly of the first module 100 may correspondingly need to be changed to a reduction gearbox assembly with another specification of a different structure or a different gear ratio. In this variant, both the input side interface and the output side interface of the first module 100 are configured in a platform-based manner, so that reduction gearbox assemblies with different specifications can be used for replacement. In addition, an input side interface of the second module 200 is configured in a platform-based manner, to adapt to reduction gearbox assemblies with different specifications.

In addition, a stroke or a diameter of the plunger may need to be changed according to different working conditions of fracturing equipment. According to a variant of the present disclosure, a change to the stroke of the plunger is generally implemented by used crankcase assemblies with different specifications for replacement. In this variant, both the input side interface and the output side interface of the second module 200 are configured in a platform-based manner, so that crankcase assemblies with different specifications can be used for replacement. In addition, the input side interface of the third module 300 is configured in a platform-based manner, to adapt to crankcase assemblies with different specifications.

According to a variant of the present disclosure, a change to the diameter of the plunger is generally implemented by used fluid end assemblies with different specifications for replacement. In this variant, the input side interface of the fourth module 400 is configured in a platform-based manner, so that fluid end assemblies with different specifications can be used for replacement. In addition, the output side interface of the fifth module 500 is configured in a platform-based manner, to adapt to fluid end assemblies with different specifications.

When the diameter and/or the stroke of the plunger change little, the spacer frame assembly and the crosshead box assembly are sometimes compatible with these changes without replacement. However, when the diameter and/or the stroke of the plunger change greatly, the spacer frame assembly and/or the crosshead box assembly may not be sufficient to be compatible with these changes. In this case, for example, the input side interface and the output side interface of each of the third module 300 and/or the fifth module 500 are configured in a platform-based manner, so that crosshead box assemblies and/or spacer frame assemblies with different specifications can be used for replacement.

According to the foregoing embodiment and various variants of the present disclosure, platformization of a part or all of external interfaces of the first module 100 to the fifth module 500 is achieved, so that a part or all of the reduction gearbox assembly 110, the crankcase assembly 210, the crosshead box assembly 310, the spacer frame assembly 510, and the fluid end assembly 410 can be separately replaced with ones with different specifications.

[1.1 Overview of Connections]

Two levels of connections are used in the split-type plunger pump of the present disclosure. The first level of connection is to use a long bolt for overall fastening and pre-tightening, and the second level of connection is to implement sealing and tightening between connection surfaces by using a combination of a flange and/or a bolt or the like and a sealing member between the reduction gearbox assembly 110 and the transmission shaft output port of the power source, between the crankcase assembly 210 and the reduction gearbox assembly 110, between the crosshead box assembly 310 and the crankcase assembly 210, between the spacer frame assembly 510 and the crosshead box assembly 310, and between the fluid end assembly 410 and the spacer frame assembly 510. The sealing member includes a sealing groove provided on the connection surface and a sealing part such as a sealing ring arranged in the sealing groove, so that oil and gas leakage can be avoided between the connection surfaces and external water vapor can be prevented from entering.

Figure 2A:
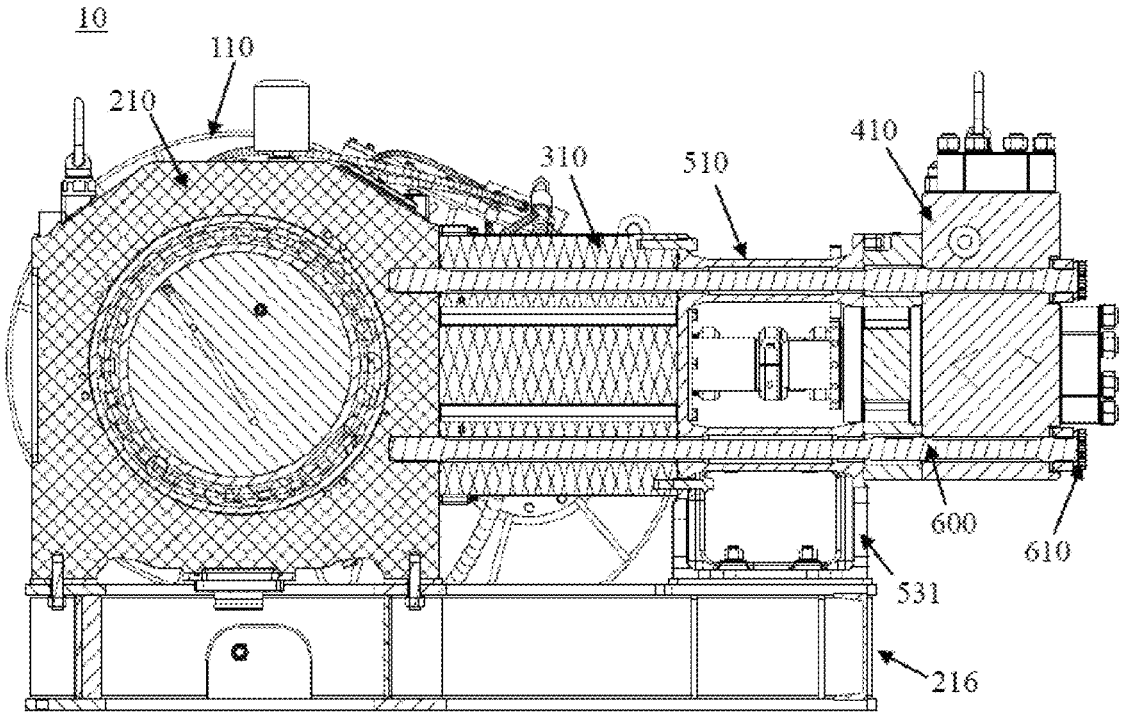
FIG. 2A and FIG. 2B are respectively a sectional view and a perspective view illustrating an example of a split-type plunger pump connected via a long bolt according to an embodiment of the present disclosure.
Figure 2B:
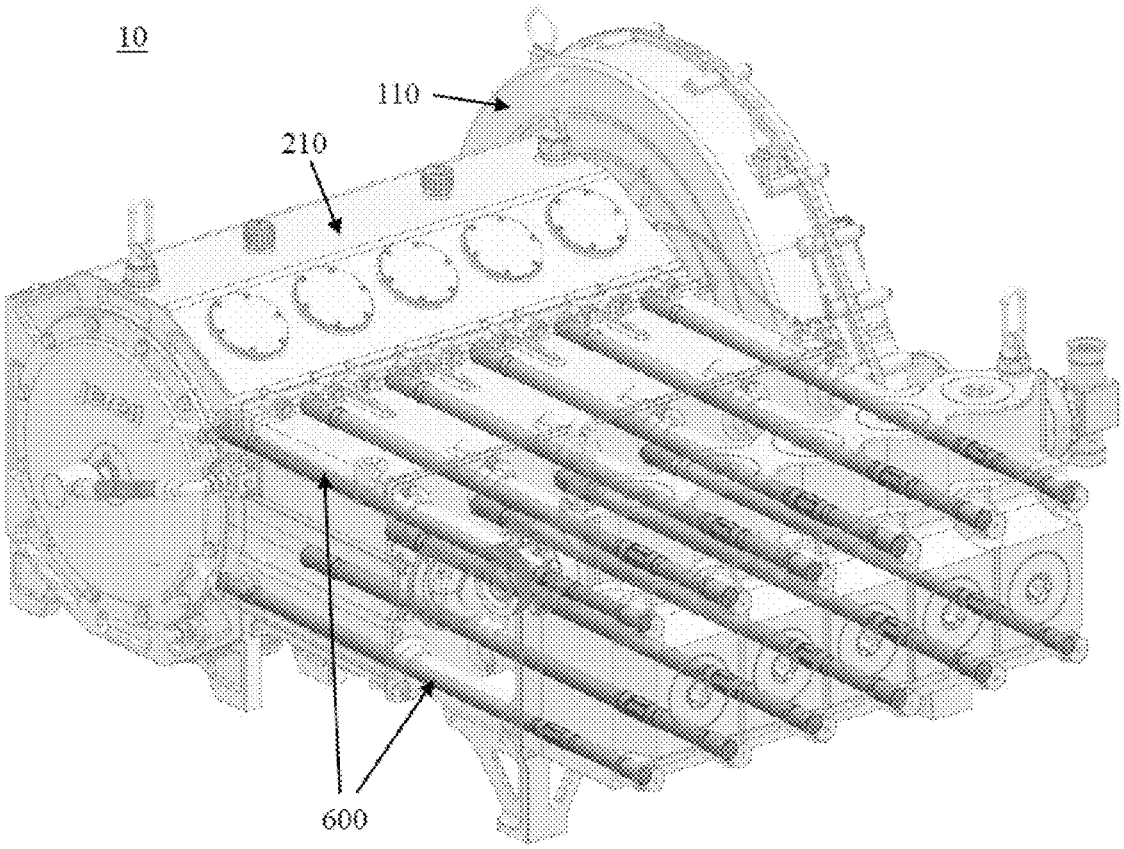

The second level of connection is described in detail later, and only the first level of connection is described herein. FIG. 2A and FIG. 2B are respectively a sectional view and a perspective view illustrating a split-type plunger pump connected via a long bolt according to an embodiment of the present disclosure. As shown in FIG. 2A and FIG. 2B, multiple (but not limited to 12 shown in the present disclosure) long bolts 600 run through the fluid end assembly 410, the spacer frame assembly 510, and the crosshead box assembly 310, and one end of each of the long bolts 600 reaches the interior of the crankcase assembly 210, thereby implementing a physical connection between these assemblies via a rigidly sealed structure. One end of the long bolt 600 is connected in a threaded manner in the crankcase assembly 210. In addition, a fastening nut 610 is arranged in a threaded manner on the other end of the long bolt 600 exposed to the outside of the fluid end assembly 410, to fasten the long bolt 600. FIG. 2A and FIG. 2B show an example in which 6 long bolts 600 are arranged evenly in the upper and lower rows respectively, but the present disclosure is not limited to such a long bolt quantity and a layout manner.

As shown in FIG. 2A, a support base 216 may be arranged below the crankcase assembly 210, and is used as a base of the entire plunger pump. In addition, a support bracket 531 may be arranged below the spacer frame assembly 510 to support the third module 300 to the fifth module 500 and to maintain the three modules at a height adapted to the second module 200. In a case in which the spacer frame assembly 510 is not arranged, the support bracket 531 may be arranged, for example, below the crosshead box assembly 310 and/or the fluid end assembly 410.

In addition, as a variant, to reduce deformation and vibration of the reduction gearbox assembly 110 during running with a load, a support pull rod (not shown) may also be arranged between the reduction gearbox assembly 110 and the crosshead box assembly 310 in a position of one side of the reduction gearbox assembly 110 extending to the crosshead box assembly 310, to provide auxiliary support for the reduction gearbox assembly 110. In still another variant, the support pull rod may not be arranged between the reduction gearbox assembly 110 and the crosshead box assembly 310, but between the reduction gearbox assembly 110 and the support base 216.

[1.2 Overview of a Transmission Manner]

Figure 3A:
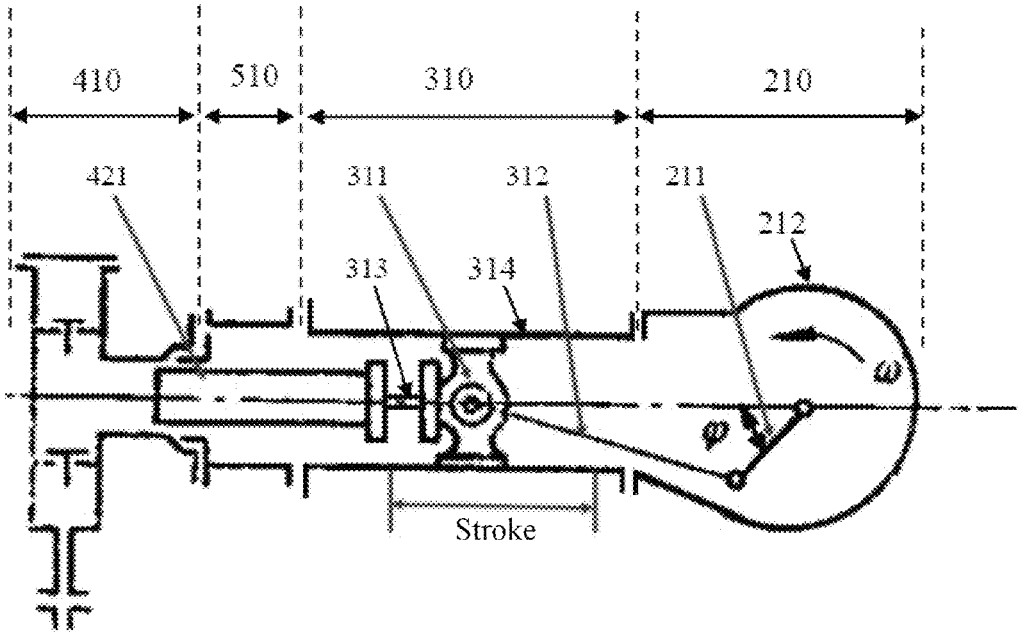
FIG. 3A is a schematic diagram used to describe a transmission manner in a split-type plunger pump according to an example embodiment of the present disclosure.
Figure 3B:
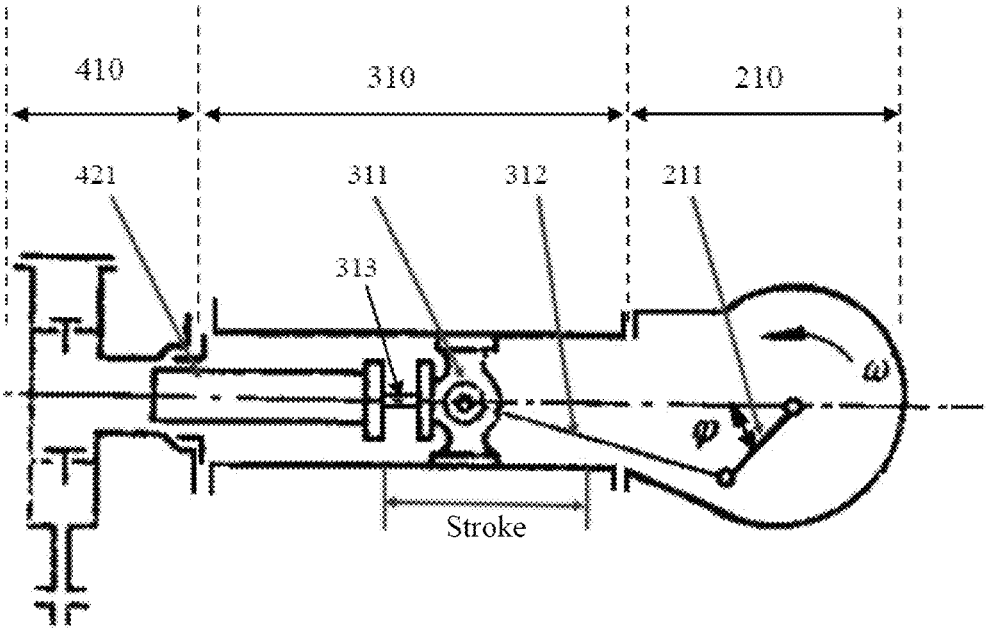
FIG. 3B to FIG. 3D are respectively first to third variants of the transmission manner shown in FIG. 3A.
Figure 3C:
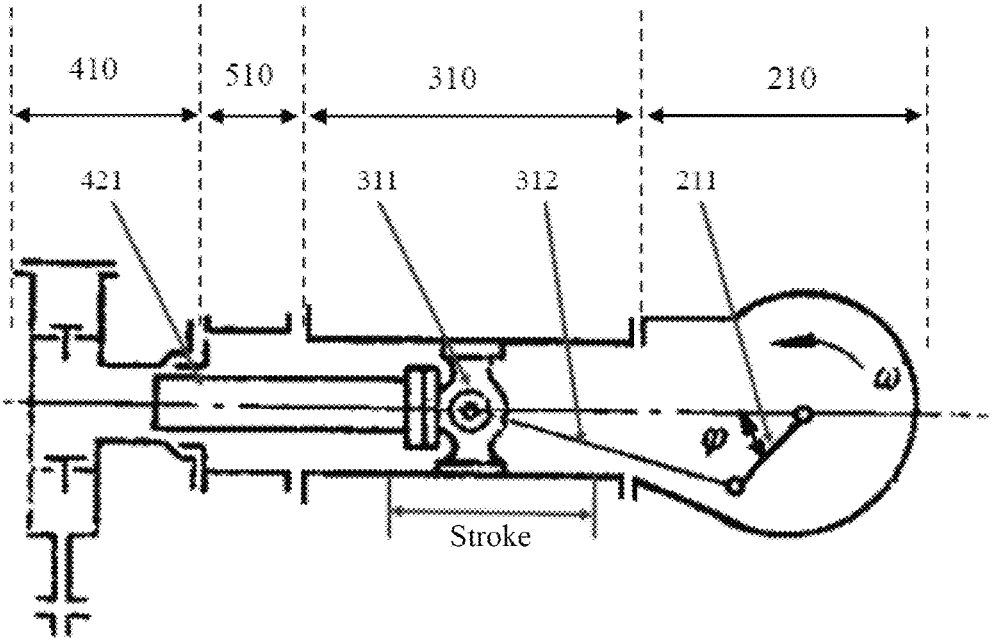
Figure 3D:
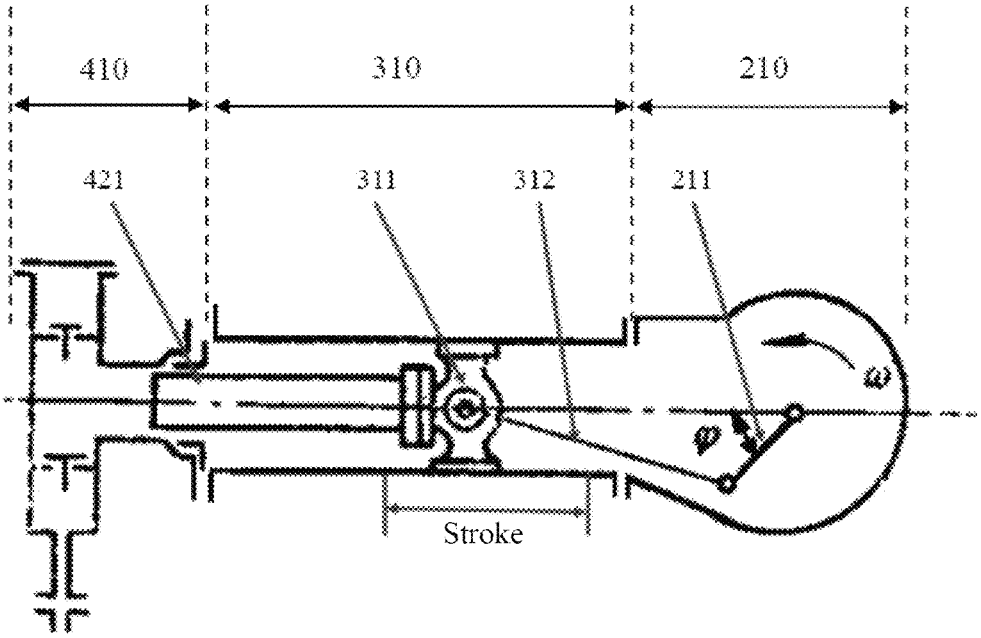

FIG. 3A is a schematic diagram used to describe a transmission manner in a split-type plunger pump according to an embodiment of the present disclosure. FIG. 3B to FIG. 3D are respectively first to third variants of the transmission manner shown in FIG. 3A. As shown in FIG. 3A, the crankcase assembly 210 includes a crankcase housing 212 and a crankshaft 211 arranged in the crankcase housing 212. The crankshaft 211 can rotate around a center of rotation in the crankcase housing 212. The crosshead box assembly 310 includes a crosshead box housing 314 and a crosshead 311 arranged in the crosshead box housing 314, and the crosshead 311 can perform linear reciprocating motion in the crosshead box housing 314. One end of the crosshead 311 is connected to a small end of a connecting rod 312, a large end of the connecting rod 312 is connected to the other end of the crankshaft 211 opposite to one end at the center of rotation, and the other end of the crosshead 311 is connected to one end of a plunger 421 of the fluid end assembly 410 via a pull rod 313.

Although not specifically shown in the accompanying drawings, an output end of the drive shaft of the power source outputs power to an input shaft of the reduction gearbox assembly 110 via the transmission shaft, and an output shaft of the reduction gearbox assembly 110 outputs rotary power to the crankshaft 211 of the crankcase assembly 210, thereby causing the crankshaft 211 to rotate. Next, as can be seen from FIG. 3A, the large end of the connecting rod 312 is driven by rotation of the crankshaft 211 to perform circumferential rotation, to implement power transmission. As the large end of the connecting rod 312 performs circumferential rotation, the small end of the connecting rod 312 pushes and pulls the crosshead 311, so that the crosshead 311 performs linear reciprocating motion. The crosshead 311 transfers linear reciprocating motion to one end of the plunger 421 via the pull rod 313, and the linear reciprocating motion of the plunger 421 causes the other end of the plunger 421 to alternately generate a vacuum or pressure in a cavity of the fluid end assembly 410, so that the fluid end assembly 410 can suck or discharge liquids. The sucked liquids are discharged after being pressurized, and the discharged liquids are used for fracturing or cementing operations.

In FIG. 3A, the split-type plunger pump of the present disclosure uses a configuration including the spacer frame assembly 510 and the pull rod 313, which enables components for reciprocating motion of the plunger 421 to be implemented with a lightest structure. In addition, a frame structure of the spacer frame assembly 510 described later can not only provide a large maintenance space for a packing assembly and the like of the fluid end assembly 410, but also provide a more stable support and connection to the fluid end assembly 410. In the first variant shown in FIG. 3B, the spacer frame assembly 510 in FIG. 3A is omitted, in which case the first half of the crosshead box assembly 310 adjacent to the fluid end assembly 410 may be extended as needed so that the internal space of the crosshead box assembly 310 is sufficient to meet needs corresponding to the stroke of the plunger 421 (i.e., the slideway is sufficient to accommodate the reciprocating motion of the plunger 421). An advantage of such a configuration is that the structure of the plunger pump is simpler and eliminates a connection structure and a sealing structure between the spacer frame assembly 510 and the crosshead box assembly 310 in the case where the spacer frame assembly 510 is provided. In addition, because the plunger 421 is entirely accommodated in the crosshead box assembly 310, it is further avoided that impurities such as external moisture or dust adhere to the plunger 421, which could cause a potential danger of wear to the packing assembly, an oil seal, and the like.

In the second variant shown in FIG. 3C, the pull rod 313 in FIG. 3A is omitted. In this case, the crosshead 311 of the crosshead box assembly 310 is directly connected to one end of the plunger 421, which has the advantage of simplifying a transmission structure and shortening an overall length of the plunger pump. Such a configuration is particularly suitable for a pump type with a short stroke.

In the third variant shown in FIG. 3D, the spacer frame assembly 510 and the pull rod 313 in FIG. 3A are omitted. Such a configuration has the advantages of both FIG. 3B and FIG. 3C, and is most applicable to a pump type with low power and a short stroke.

[2. Platform-Based Design of a First Module]

[2.1 Reduction Gearbox Assembly]

Figure 4A:
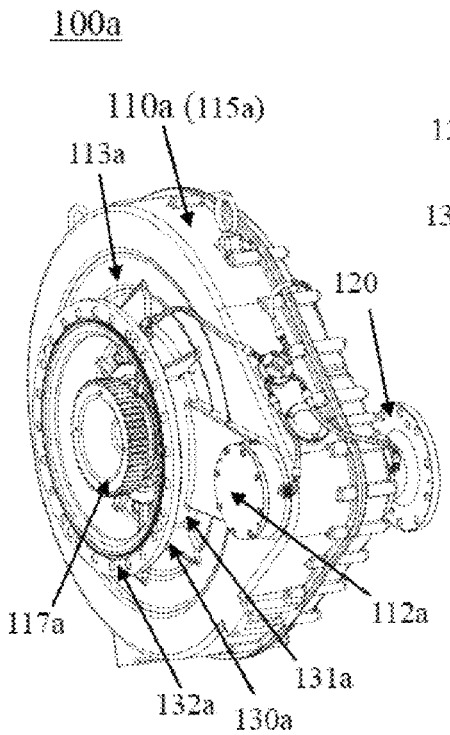
FIG. 4A is a schematic diagram illustrating an example reduction gearbox assembly of a single parallel-stage (1P) reduction structural type.
Figure 4B:
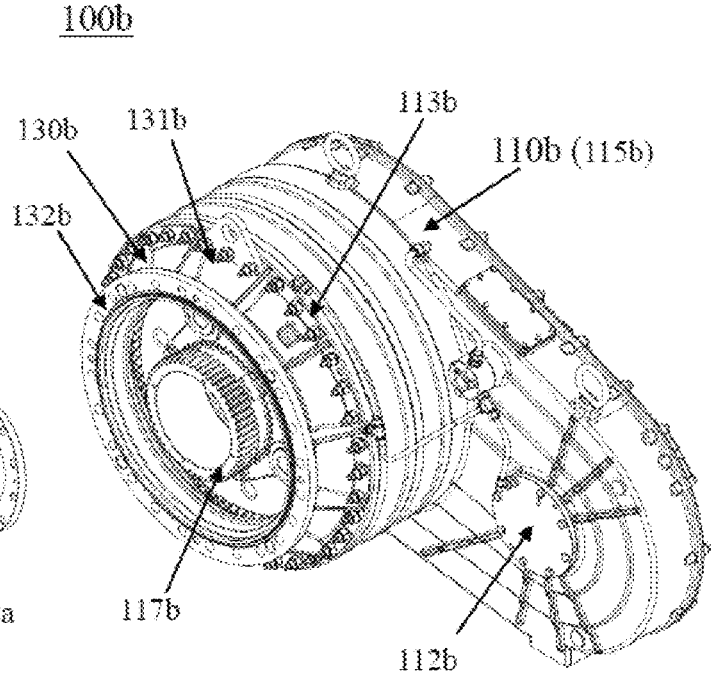
FIG. 4B is a schematic diagram illustrating an example reduction gearbox assembly of a parallel and planetary two-stage (2P) reduction structural type.
Figure 5:
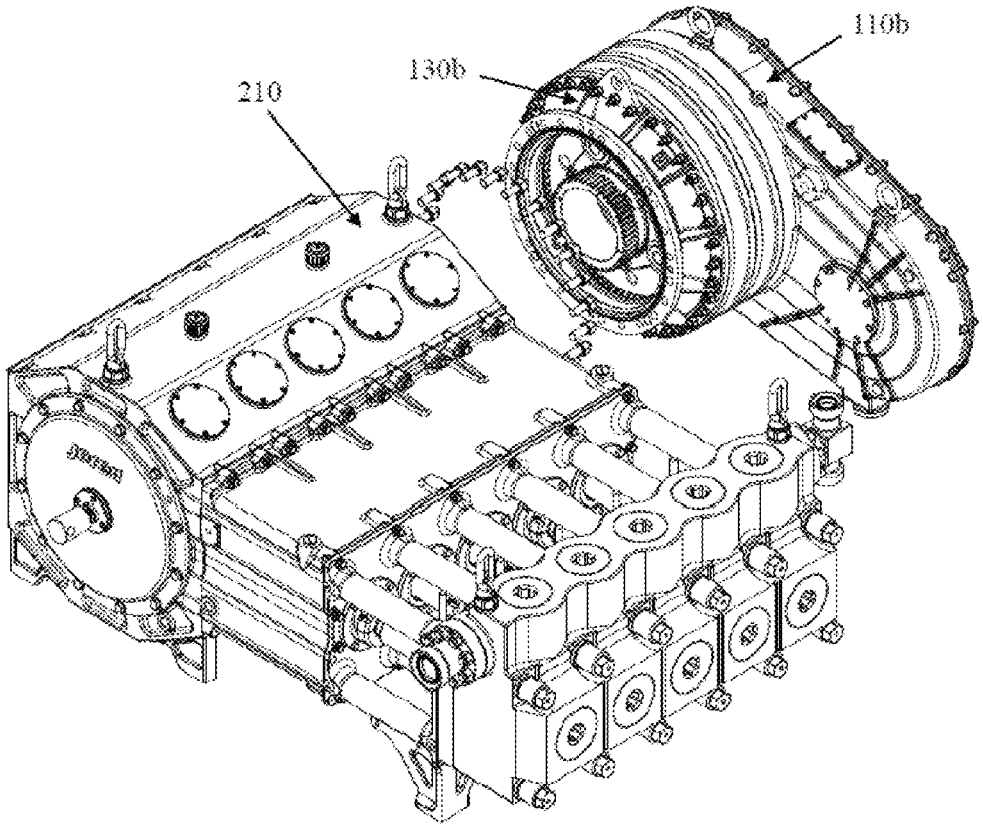
FIG. 5 and FIG. 6 are schematic diagrams of decomposition when mounting the example reduction gearbox assembly shown in FIG. 4B to a crankcase assembly.
Figure 6:
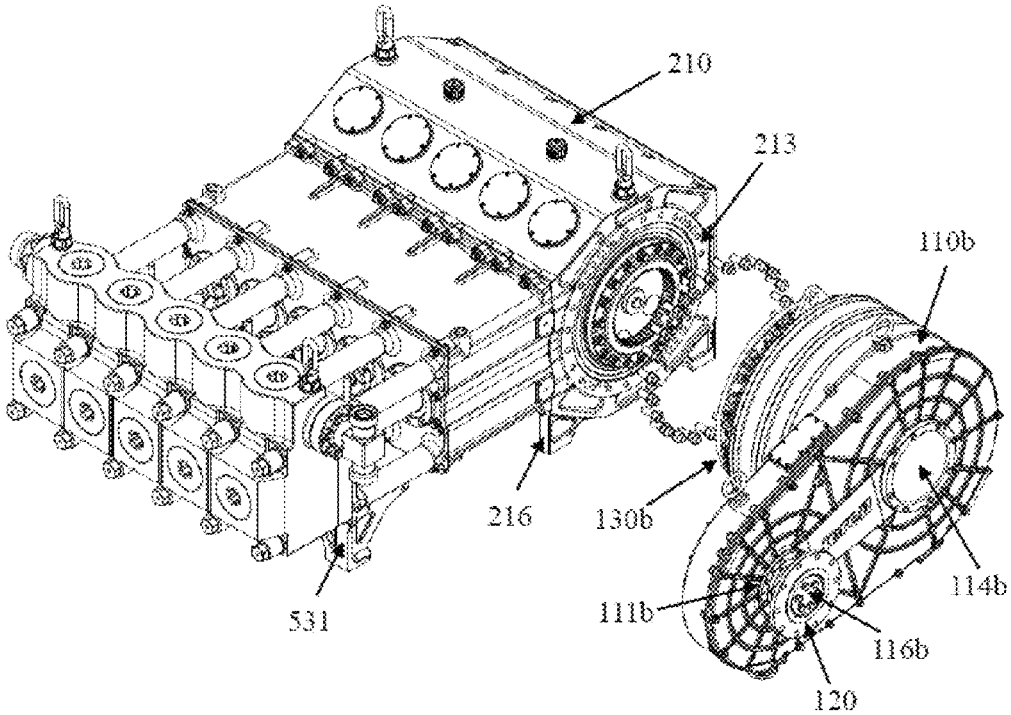

FIG. 4A is a schematic diagram illustrating a first module of a structural type, showing a reduction gearbox assembly 110*a* with a single parallel-stage (1P) reduction structural type, which will later be referred to as Type A. FIG. 4B is a schematic diagram illustrating a first module of another structural type, showing a reduction gearbox assembly 110*b* of a parallel and planetary two-stage (2P) reduction structural type, which will later be referred to as Type B. In FIG. 1A and FIG. 1B described above, an example in which the reduction gearbox assembly 110*a* shown in FIG. 4A has been mounted on the crankcase assembly 210 as the reduction gearbox assembly 110 is shown. FIG. 5 and FIG. 6 are schematic diagrams of decomposition when mounting the reduction gearbox assembly 110*b* shown in FIG. 4B to the crankcase assembly 210.

As shown in FIG. 1A and FIG. 4A, a first module 100*a* includes the reduction gearbox assembly 110*a*, the mounting flange 130*a*, and the connection flange 120. A reduction gearbox assembly 110*a* includes a reduction gearbox housing 115*a*; an input shaft 116*a* and an output shaft 117*a* that are arranged in the reduction gearbox housing 115*a*; and a gear (not shown), a bearing (not shown), and the like that are configured to from a 1P reduction structure. A first port 113*a* may be arranged on a crankcase assembly side of the reduction gearbox housing 115*a*, and forms an output port or an output flange of the reduction gearbox assembly 110*a*. The first port 113*a* surrounds one end of the output shaft 117*a* extending toward the crankcase assembly side. The other end of the output shaft 117*a* facing toward a power source side is sealed by a flange cover 114*a*. A second port 111*a* may be arranged on the power source side of the reduction gearbox housing 115*a*, and forms an input port or an input flange of the reduction gearbox assembly 110*a*. The second port 111*a* surrounds one end of the input shaft 116*a* extending toward the power source side. The other end of the input shaft 116*a* facing toward the crankcase assembly side is sealed by a flange cover 112*a*.

As shown in FIG. 4B and FIG. 6, a first module 100*b* includes a reduction gearbox assembly 110*b*, a mounting flange 130*b*, and a connection flange 120. A reduction gearbox assembly 110*b* includes a reduction gearbox housing 115*b*; an input shaft 116*b* and an output shaft 117*b* that are arranged in the reduction gearbox housing 115*b*; and a gear (not shown), a bearing (not shown), and the like that are configured to from a 2P reduction structure. A first port 113*b* may be arranged on a crankcase assembly side of the reduction gearbox housing 115*b*, and forms an output port or an output flange of the reduction gearbox assembly 110*b*. The first port 113*b* surrounds one end of the output shaft 117*b* extending toward the crankcase assembly side. The other end of the output shaft 117*b* facing toward a power source side is sealed by a flange cover 114*b*. A second port 111*b* may be arranged on the power source side of the reduction gearbox housing 115*b*, and forms an input port or an input flange of the reduction gearbox assembly 110*b*. The second port 111*b* surrounds one end of the input shaft 116*b* extending toward the power source side. The other end of the input shaft 116*b* facing toward the crankcase assembly side is sealed by a flange cover 112*b*.

In the present disclosure, reduction gearbox assemblies with different specifications may have different gear ratios in a range of 5:1 to 15:1, and as described later in this specification, three gear ratios a=6.353:1, b=7.8:1, and c=13:1 are exemplified. The present disclosure is not limited to reduction gearbox assemblies of the foregoing two structural types, but may use any reduction gearbox assembly that can be used as a power transmission system of a plunger pump as long as its function is to convert power output from a prime mover (a power source such as an internal combustion engine, an electric motor, or a turbine engine) by using different gear ratio variable designs of a gear inside the reduction gearbox assembly, to achieve an effect of speed reduction and torque increasing (that is, converting high-speed low-torque motion of the prime mover into low-speed high-torque motion with a load) or an effect of speed increasing and torque reduction (that is, converting low-speed high-torque motion of the prime mover into high-speed low-torque motion with a load), thereby providing different transmission capabilities for the fracturing equipment.

[2.2 Connections on a Crankcase Assembly Side of the Reduction Gearbox Assembly]

In the first module 100*a* shown in FIG. 4A, the mounting flange 130*a* may be connected to the first port 113*a* on the crankcase assembly side of the reduction gearbox housing 115*a*. As an example, a first end 131*a* of the mounting flange 130*a* may be welded or integrally cast to the first port 113*a* of the reduction gearbox housing 115*a*. Alternatively, as another preferred example, the first end 131*a* of the mounting flange 130*a* may be provided with multiple positioning holes in a circumferential direction, to be mounted to corresponding multiple positioning holes on the first port 113*a* of the reduction gearbox housing 115*a* via multiple double-ended studs and nuts. A second end 132*a* of the mounting flange 130*a* may be provided with positioning holes configured in a platform-based manner in the circumferential direction, to be mounted to corresponding positioning holes configured in a platform-based manner on an input port (or an input flange) 213 of the crankcase assembly 210 via a double-ended stud and a nut configured in a platform-based manner.

In the present disclosure, at the first end 131*a* of the mounting flange 130*a*, the positioning holes may alternatively be evenly arranged at a specified circumferential interval. At the second end 132*a* of the mounting flange 130*a*, the positioning holes may be evenly arranged at a specified interval that is the same as or different from the specified interval at the first end 131*a*.

In this way, the present disclosure mainly uses the mounting flange 130*a* to fasten the reduction gearbox assembly 110*a* to the crankcase assembly 210, and the weight of the reduction gearbox assembly 110*a* is almost all supported by structural rigidity of the crankcase assembly 210 and the mounting flange 130*a*. An end surface of the first end 131*a* of the mounting flange 130*a* and an end surface of the first port 113*a* of the reduction gearbox housing 115*a* may be sealed via the foregoing sealing member. In addition, an end surface of the second end 132*a* of the mounting flange 130*a* and an end surface of the input port 213 of the crankcase assembly 210 may also be sealed via the foregoing sealing member. The output shaft 117*a* of the reduction gearbox assembly 110*a* and the crankshaft of the crankcase assembly 210 are mutually fitted and connected via an internal spline and an external spline.

As a preferred example of the support pull rod, twin screws (not shown) having sufficient rigidity, strength and length may be selected, one end of the twin screws is fastened to one side of the crosshead box assembly 310, and the other end of the twin screws is connected to the crankcase assembly side of the reduction gearbox assembly 110*a*. In this way, auxiliary support by the twin screws can withstand a part of the weight of the reduction gearbox assembly 110*a* and can cushion deformation and vibration produced when the reduction gearbox assembly 110*a* is operating, to reduce the load on the mounting flange 130*a* and the crankcase assembly 210.

The connections on the crankcase assembly side of the reduction gearbox assembly 110*b* shown in FIG. 4B are basically similar to those of the reduction gearbox assembly 110*a*. However, because the 2P reduction structure of the reduction gearbox assembly 110*b* causes that the size of the reduction gearbox housing 115*b* is different from the size of the reduction gearbox housing 115*a*, the first port 113*b* of the reduction gearbox housing 115*b* and the first end 131*b* of the mounting flange 130*b* adapted thereto may also be different in size from the first port 113*a* of the reduction gearbox housing 115*a* and the first end 131*a* of the mounting flange 130*a* adapted thereto.

In the present disclosure, for the reduction gearbox assembly 110*a* and the reduction gearbox assembly 110*b* with different gear ratios and different structures, as well as reduction gearbox assemblies 110 with any other specifications, they are configured in a platform-based manner at least at the second ends 132*a*, 132*b*, and 132 of corresponding mounting flanges 130*a*, 130*b*, and 130. That is, mounting flange specifications (for example, sizes of at least the second ends of the mounting flanges) are the same; positioning hole specifications (for example, a quantity, sizes, and an arrangement manner of positioning holes on at least the second ends of the mounting flanges) are the same; bolt and nut specifications (for example, a quantity, sizes, and types (such as metric or imperial units) of bolts and nuts corresponding to positioning holes on at least the second ends of the mounting flanges) are the same; torque specifications (for example, tightening torque and thread parameters, etc., torque and fastening requirements) are the same; sealing member specifications (for example, sealing groove and sealing ring thickness at least at the second ends of the mounting flanges, and positions relative to the central axis, etc.) are the same; and spline specifications (such as types, models, and parameters of splines of the output shaft for connecting to the crankshaft) are the same.

Generally speaking, for reduction gearbox assemblies with different structures and/or different gear ratios within a same platform, at least at the second ends 132 of the mounting flanges 130, the mounting flange specifications, the positioning hole specifications, the bolt and nut specifications, the torque specifications, the sealing member specifications, and the spline specifications of the output shaft for connecting to the crankshaft are exactly the same. This is equivalent to that the output side interface of the first module described in the claims is configured in a platform-based manner. In this way, the reduction gearbox assembly can be replaced with one with a different specification when the external interfaces are standardized and uniformed.

The platform-based design of the present disclosure is not limited to any specific interface design manner or interface parameter described in this specification, provided that they are uniformed or standardized.

[2.3 Connections on a Power Source Side of the Reduction Gearbox Assembly]

In the reduction gearbox assembly 110*a* shown in FIG. 4A, the connection flange 120 may be connected to the second port 111*a* on the power source side of the reduction gearbox housing 115*a*. As an example, an inside port 121 of the connection flange 120 may be welded or integrally cast to the second port 111*a* of the reduction gearbox housing 115*a*. Alternatively, as another preferred example, multiple positioning holes may be provided on the inside port 121 of the connection flange 120 in the circumferential direction, to be mounted to corresponding multiple positioning holes on the second port 111*a* of the reduction gearbox housing 115*a* via multiple bolts and nuts. Positioning holes configured in a platform-based manner may be provided on an outside port 122 of the connection flange 120 in the circumferential direction, to be mounted to corresponding positioning holes configured in a platform-based manner on the transmission shaft output port of the power source via bolts and nuts configured in a platform-based manner.

An end surface of the inside port 121 of the connection flange 120 and an end surface of the second port 111*a* of the reduction gearbox housing 115*a* may be sealed via the foregoing sealing member. In addition, an end surface of the outside port 122 of the connection flange 120 and an end surface of the transmission shaft output port of the power source may also be sealed via the foregoing sealing member. The input shaft 116*a* of the reduction gearbox assembly 110*a* and the transmission shaft of the power source are mutually fitted and connected via an internal spline and an external spline.

Connections on the power source side of the reduction gearbox assembly 110*b* are basically similar to those of the reduction gearbox assembly 110*a*, and details are not described again.

Figure 7:
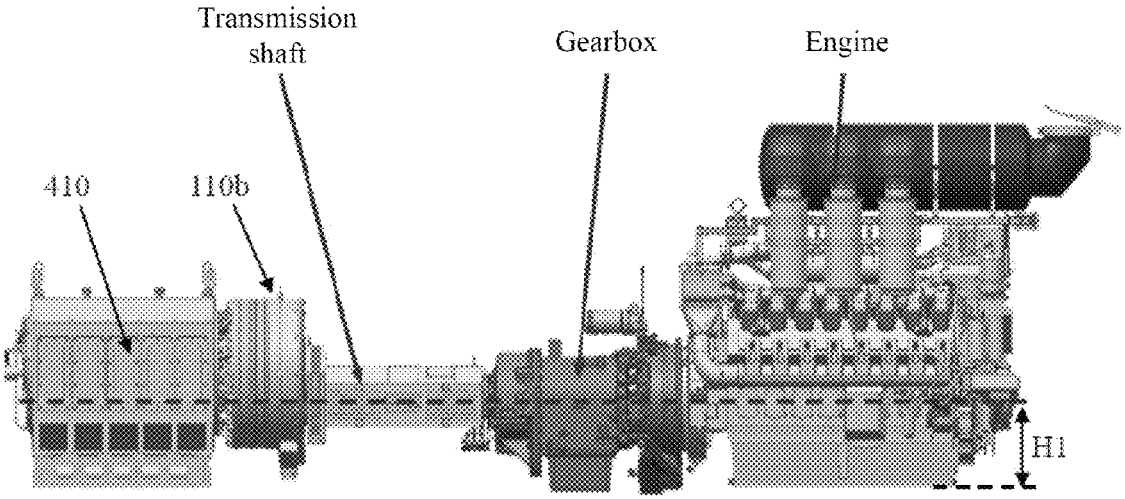
FIG. 7 is a plan view illustrating an example of a split-type plunger pump driven by an engine according to an example embodiment of the present disclosure.
Figure 8:
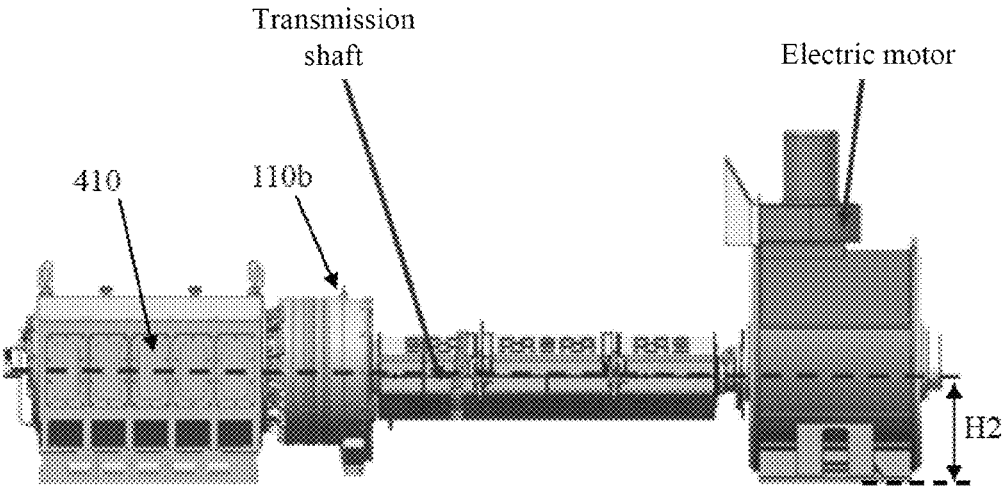
FIG. 8 is a plan view illustrating an example of a split-type plunger pump driven by an electric motor according to an example embodiment of the present disclosure.

FIG. 7 is a plan view illustrating an example of a split-type plunger pump driven by (such as a fuel, gas, dual fuel, or turbine) engine according to an embodiment of the present disclosure. In this example, the engine is typically equipped with a gearbox to implement speed reduction and torque increasing, and an input rotational speed provided for the plunger pump is typically 800 rpm to 1100 rpm. FIG. 8 is a plan view illustrating an example of a split-type plunger pump driven by an electric motor according to an embodiment of the present disclosure. In this example, the electric motor is directly connected to the plunger pump using a transmission shaft, and an input rotational speed provided for the plunger pump is typically 1400 rpm to 1900 rpm. As can be seen from FIG. 7 and FIG. 8, a height position of a drive shaft of the electric motor is generally higher than a height position of a drive shaft of the engine (H2>H1).

According to the present disclosure, because the reduction gearbox assembly 110*b* is fastened to the crankcase assembly 210 via the mounting flange 130*b*, during mounting, the reduction gearbox assembly 110*b* rotates by at least one of positioning holes of the mounting flange 130*b* to adjust the second port 111*b* of the reduction gearbox housing 115*b* (and the connection flange 120 connected thereto), so that the height position of the outside port 122 of the connection flange 120 is substantially aligned with the height position of a drive shaft of a prime mover with selected specification, and then the reduction gearbox assembly 110*b* is fastened to the crankcase assembly 210. For example, the reduction gearbox assembly 110*b* rotating by one hole on the second end 132*b* of the mounting flange 130*b* is equivalent to rotating by 15° or other degrees.

Preferably, in a case in which the positioning holes of the first end 131*b* of the mounting flange 130*b* and the positioning holes of the second end 132*b* are not equally provided, the reduction gearbox assembly 110*b* may rotate by at least one of the positioning holes of the first end 131*b* and/or at least one of the positioning holes of the second end 132*b*. In the present disclosure, the reduction gearbox assembly 110*b* may rotate clockwise or counterclockwise.

In conclusion, the reduction gearbox assemblies 110*a*, 110*b*, and 110 of the present disclosure can adapt to height positions of drive shafts of prime movers with different specifications because they can rotate during mounting. In addition, for at least the outside port 122 of the connection flange 120, connection flange specifications, positioning hole specifications, bolt and nut specifications, torque specifications, sealing member specifications, and spline specifications of the input shaft for connecting to the transmission shaft are exactly the same. This is equivalent to that the input side interface of the first module described in the claims is configured in a platform-based manner. In this way, transmission shaft output ports of power sources with different specifications can be adapted when the external interfaces are standardized and uniformed.

[3. Platform-Based Design of a Second Module]

[3.1 Crankcase Assembly]

Figure 9:
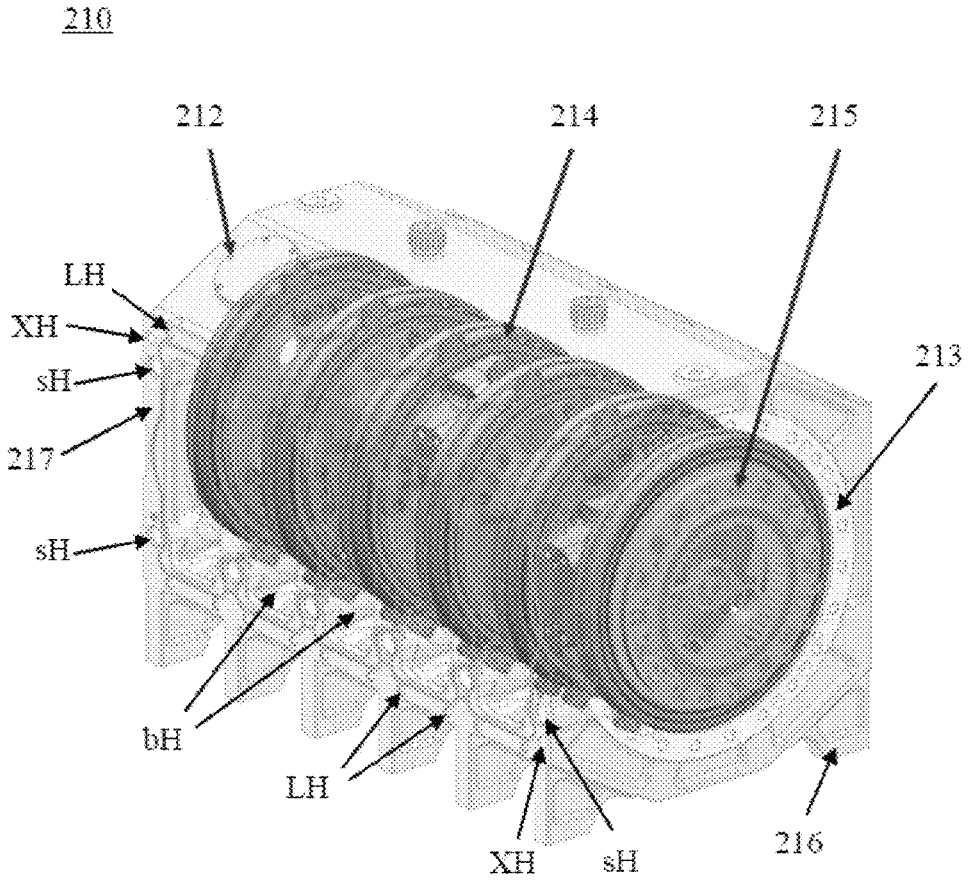
FIG. 9 is a perspective view illustrating a configuration example of a crankcase assembly according to an example embodiment of the present disclosure.

FIG. 9 is a perspective view illustrating a configuration example of a crankcase assembly according to an embodiment of the present disclosure. The crankcase assembly 210 includes the crankcase housing 212; and a crankshaft bearing 214 and a crankshaft component 215 that are arranged in the crankcase housing 212. The crankshaft component 215 includes the crankshaft 211.

The input port (or the input flange) 213 is arranged on the reduction gearbox assembly side of the crankcase housing 212, and forms an input port of the crankcase assembly 210, to connect to the reduction gearbox assembly 110*b*. A front end surface 217 is arranged on the crosshead box assembly side of the crankcase housing 212, and forms an output port of the crankcase assembly 210, to connect to the crosshead box assembly 310.

Multiple positioning holes may be provided on the input port (or the input flange) 213 at a specified circumferential interval, and a sealing groove may be arranged on the end surface of the input port (or the input flange) 213.

The front end surface 217 is penetrated by multiple large through holes bH (5 in total in a row shown in FIG. 9, which is not limiting), multiple long bolt holes sH (6 in each of upper and lower lows shown in FIG. 9, which is not limiting), multiple pin holes XH (1 on each of the left edge and the right edge shown in FIG. 9, which is not limiting), and multiple bolt holes LH (10 in each of upper and lower lows shown in FIG. 9, which is not limiting). The large through hole bH is configured to allow the connecting rod 312 to extend from the crosshead 311 to be connected to the crankshaft 211 and allow the connecting rod 312 to perform complex motion including swinging and reciprocation, and the quantity and arrangement manner of large through holes bH are the same as the quantity and arrangement manner of plungers 421. The large through hole bH may preferably have a specific margin to be compatible with variable designs of the connecting rod 312 occurring with different plunger strokes. The long bolt hole sH is configured to allow the long bolt 600 to enter to perform overall fastening and pre-tightening, and the quantity and arrangement manner of long bolt holes sH are the same as the quantity and arrangement manner of long bolts 600. The front end surface 217 is formed on the crankcase housing 212 in an integrated casting manner, for example, the pin holes XH are preferably provided on the left and right edges of the front end surface 217 respectively close to the upper and lower corners, and the pin holes XH function as positioning holes. The bolt hole LH is configured to fasten the front end surface 217 to a corresponding bolt hole on the crosshead box assembly 310 via a bolt, the bolt holes LH are preferably provided on the upper and lower edges of the front end surface 217 at an even interval, and the bolt holes LH function as mounting holes.

Referring to FIG. 3A again, a crank pin is arranged on one end portion of the crankshaft 211 away from the center of rotation, and the crank pin is connected to the large end of the connecting rod 312. The crankshaft 211 receives the rotary power input from the output shaft of the reduction gearbox assembly 110*b*, so as to rotate. The distance between the axis of the crank pin and the axis of the center of rotation of the crankshaft 211 (that is, a crank throw) determines the stroke of plunger reciprocating motion, that is, the stroke of the plunger pump product.

In addition to supporting the crankshaft 211 inside, the crankcase housing 212 is also a main bearing structural member of the entire plunger pump product, and is connected to a lower support base 216 (refer to FIG. 2A), to implement support and fastening of the entire plunger pump. In an example of the present disclosure in which the spacer frame assembly 510 is arranged, the support base 216 fits with the support bracket 531 below the spacer frame assembly 510 to provide support.

In the present disclosure, corresponding to different specifications of the plunger stroke, the crankshaft 211 of the crankcase assembly 210 may have different length specifications selected from a range of 6 in (inch) to 12 in (inch). As described later in this specification, two length specifications A-8 in and B-10 in are used as examples.

[3.2 Connections on a Reduction Gearbox Assembly Side of the Crankcase Assembly]

As described above with reference to FIG. 6, the crankcase assembly 210 is fitted and connected to the reduction gearbox assembly 110*b* via the mounting flange 130*b*. Specifically, the input port 213 is arranged on the reduction gearbox assembly side of the crankcase housing 212, and positioning holes configured in a platform-based manner are provided on the input port 213 in the circumferential direction. The positioning holes are fastened and connected to the positioning holes configured in a platform-based manner on the second end 132*b* of the mounting flange 130*b* via double-ended studs and nuts configured in a platform-based manner.

The end surface of the input port 213 of the crankcase housing 212 and an end surface of the second end 132*b* of the mounting flange 130*b* are sealed via the foregoing sealing member. In addition, as described above, the crankshaft 211 of the crankcase assembly 210 and the output shaft 117*b* of the reduction gearbox assembly 110*b* are fitted and connected via an internal spline and an external spline.

For crankcase assemblies with different crankshaft specifications in a same platform, the input port 213 on the reduction gearbox assembly side of the crankcase housing 212 is configured in a platform-based manner, for example, the flange specification, the positioning hole specification, the bolt and nut specification, the torque specification, the sealing member specification, and the spline specification of the crankshaft for connecting to the output shaft of the reduction gearbox assembly are configured in a platform-based manner, which is equivalent to that the input side interface of the second module described in the claims is configured in a platform-based manner. In this way, reduction gearbox assemblies with different specifications can be adapted when the external interfaces are standardized and uniformed.

In addition, the input side interface of the second module and the output side interface of the first module are mutually adaptively configured in a platform-based manner. For example, the positioning holes on the input port 213 of the crankcase assembly 210 and the positioning holes on the second end 132*b* of the mounting flange 130*b* have the same platform-based design (for example, the quantity, size, and layout manner of the positioning holes). In addition, the sealing groove and the sealing ring are also configured in a platform-based manner similarly on the end surfaces of the input port 213 and the second end 132*b* that are respectively used as connection surfaces. Thus, regardless of whether a crankcase assembly with a different specification or a reduction gearbox assembly with a different specification is used for replacement, the mounting and connection between the two can be still achieved.

[3.3 Connections on a Crosshead Box Assembly Side of the Crankcase Assembly]

The connection between the crankcase assembly 210 and the crosshead box assembly 310 may be described with reference to FIG. 9 and later described FIG. 13A and FIG. 13B.

As described above, the front end surface 217 is mounted on the crosshead box assembly side of the crankcase housing 212. In a case in which multiple large through holes bH, multiple long bolt holes sH, multiple bolt holes LH, and multiple pin holes XH that are provided in the front end surface 217 are respectively aligned with corresponding multiple large through holes, multiple long bolt holes, multiple bolt holes, and multiple pin holes that are provided in a rear end surface 317 of the crosshead box assembly 310, the long bolts 600 are inserted through the long bolt holes of the two sides to implement the first level of connection (overall fastening and pre-tightening), the positioning pins are inserted through the pin holes of both sides to mount and position the front end surface 217 and the rear end surface 317, and the bolts are inserted through the bolt holes of both sides to securely fasten the front end surface 217 and the rear end surface 317 together, thereby achieving the second level of connection.

In addition, when the second level of connection is implemented, a sealing ring 219 is further arranged between the front end surface 217 of the crankcase housing 212 and the rear end surface 317 of the crosshead box assembly 310. The sealing ring 219 is arranged in a sealing groove arranged in the connection surface of the front end surface 217 and the rear end surface 317 in a manner of surrounding the multiple large through holes, to implement a sealing connection for the multiple large through holes between the connection surfaces of the two. In this way, oil and gas leakage between the connection surfaces can be avoided, and water vapor and other intrusions can be prevented, which otherwise could result in contamination of the lubricating oil and corrosion and wear of the internal metal parts.

For crankcase assemblies with different crankshaft specifications in a same platform, the bolt hole specifications, the bolt specifications, the pin hole specifications, the positioning pin specifications, the large through hole specifications, the long bolt hole specifications, the torque specifications, and the sealing member specifications on the crosshead box assembly side of the crankcase assembly in the present disclosure are exactly the same. This is equivalent to that the output side interface of the second module described in the claims is configured in a platform-based manner. In this way, crankcase assemblies with different specifications can be used for replacement and crosshead box assemblies with different specifications can be adapted when the external interfaces are standardized and uniformed.

[4. Platform-Based Design of a Third Module]

[4.1 Crosshead Box Assembly]

Figure 10A:
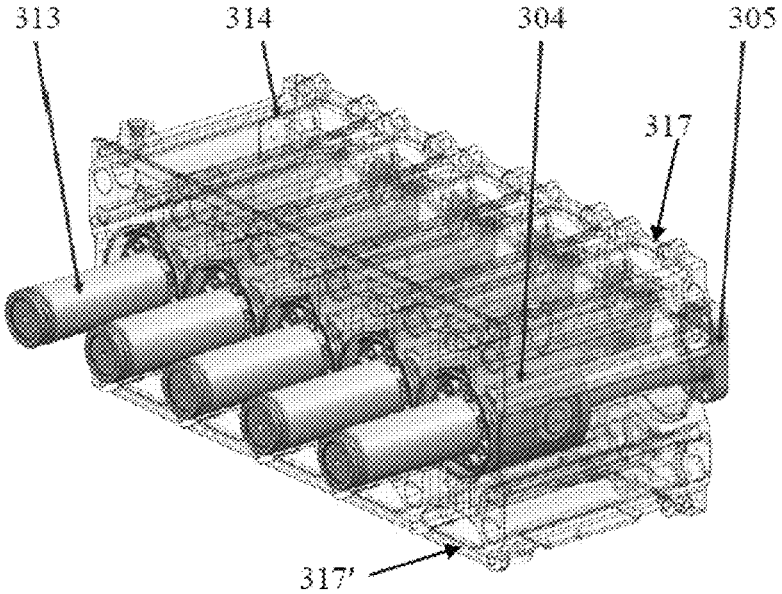
FIG. 10A and FIG. 10B are respectively a perspective view and a schematic diagram illustrating a configuration example of a crosshead box assembly according to an embodiment of the present disclosure.
Figure 10B:
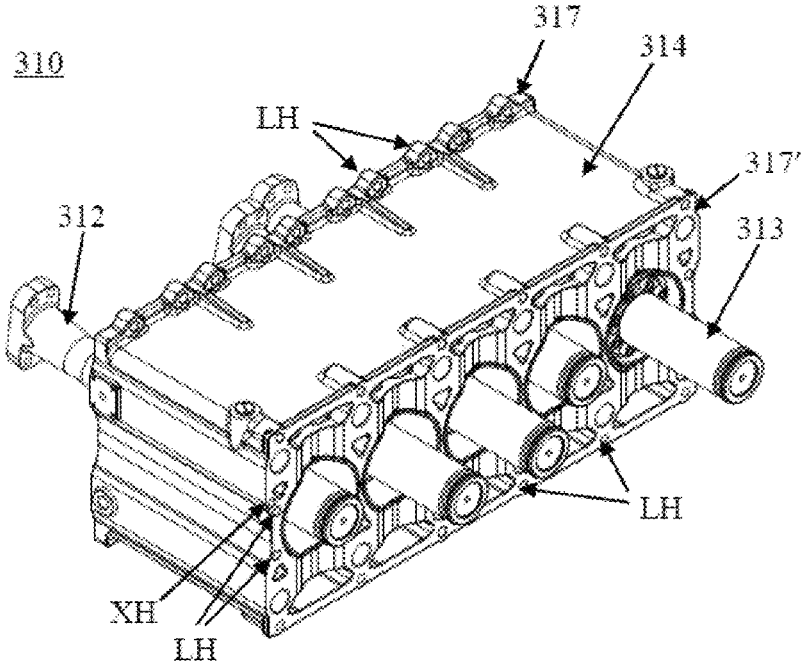

FIG. 10A and FIG. 10B are respectively a perspective view and a schematic diagram illustrating a configuration example of a crosshead box assembly according to an embodiment of the present disclosure. As shown in FIG. 10A, the crosshead box assembly 310 mainly includes a crosshead box housing 314, a crosshead box assembly 304, a connecting rod assembly 305, a pull rod 313, and the like. The crosshead box assembly 304 includes a crosshead 311, and the connecting rod assembly 305 includes a connecting rod 312. The crosshead box assembly 304 is configured to convert rotational motion of the crankshaft 211 into linear reciprocating motion of the crosshead 311 in the axial direction via the connecting rod 312.

As shown in FIG. 10B, a rear end surface 317 is arranged on the crankcase assembly side of the crosshead box housing 314, and forms an input port of the crosshead box assembly 310. The rear end surface 317 is formed on the crosshead box housing 314 in a manner such as integral casting. Multiple bolt holes LH that are one-to-one corresponding to multiple bolt holes LH in the front end surface 217 of the crankcase assembly 210 are respectively provided on the upper edge and the lower edge of the rear end surface 317 that protrude upwardly and downwardly relative to the crosshead box housing 314. In addition, although not shown, similar to the front end surface 217 of the crankcase assembly 210, the rear end surface 317 of the crosshead box housing 314 is also penetrated by multiple large through holes bH and multiple long bolt holes sH. Herein, the large through hole bH is configured to allow the connecting rod 312 to extend through and allow the connecting rod 312 to perform complex motion including swinging and reciprocating, and may preferably have a specific margin to be compatible with variable designs of the connecting rod 312 occurring with different plunger strokes. The long bolt hole sH is configured to allow the long bolt 600 to pass through, thereby performing overall fastening and pre-tightening. In addition, although not shown, similar to the front end surface 217 of the crankcase assembly 210, the rear end surface 317 of the crosshead box housing 314 is also penetrated by multiple pin holes XH (for example, 1 on each of the left edge and the right edge).

As shown in FIG. 10B, a front end surface 317' is arranged on the spacer frame assembly side of the crosshead box housing 314 in an integral casting manner, for example, to form an output port of the crosshead box assembly 310. The front end surface 317' of the crosshead box housing 314 is penetrated by multiple large through holes (5 in total in a row shown in FIG. 10B, which is not limiting), multiple long bolt holes (6 in each of upper and lower lows shown in FIG. 10B, which is not limiting), multiple bolt holes LH (6 on each of the upper edge and the lower edge and 2 on each of the left edge and the right edge shown in FIG. 10B, which is not limiting), and multiple pin holes XH (1 on each of the left edge and the right edge shown in FIG. 10B, which is not limiting). Herein, the large through hole is configured to allow the pull rod 313 to drive the plunger 421 to perform reciprocating motion, and may preferably have a specific margin to be compatible with variable designs of different plunger diameters. The long bolt hole is configured to allow the long bolt 600 to pass through, thereby performing overall fastening and pre-tightening. The pin hole XH is configured to mount and position the crosshead box housing 314 and the spacer frame assembly 510 via a positioning pin. The bolt hole LH is configured to fasten and connect the crosshead box housing 314 to the spacer frame assembly 510 via a bolt.

In the present disclosure, the pull rod 313 in the crosshead box assembly 310 may have different length specifications within a range of 6 in to 12 in. As described later in this specification, two length specifications A-8 in and B-10 in are used as examples.

[4.2 Connections on a Crankcase Assembly Side of the Crosshead Box Assembly]

As described above with reference to FIG. 13A and FIG. 13B, the connection between the crosshead box assembly 310 and the crankcase assembly 210 is as follows: (1) The long bolts 600 pass through the corresponding long bolt holes sH in the rear end surface 317 and the front end surface 217 to achieve the first level of connection (overall fastening and pre-tightening). (2) Cylindrical positioning pins pass through the corresponding pin holes XH in the rear end surface 317 and the front end surface 217 to mount and position the rear end surface 317 and the front end surface 217. Bolts pass through the corresponding bolt holes LH in the rear end surface 317 and the front end surface 217 to fasten the rear end surface 317 and the front end surface 217 together. In addition, the sealing ring 219 forms a sealing connection between the connection surfaces of the rear end surface 317 and the front end surface 217, thereby achieving the second level of connection.

With the sealing connection via the sealing ring 219, the lubricating oil in the crosshead box assembly 310 and the crankcase assembly 210 can be prevented from leaking, and external water, gas, dust, and the like can also be prevented from entering the crosshead box assembly 310 and the crankcase assembly 210.

For crosshead box assemblies with different pull rod lengths (corresponding to different strokes of plunger pump products) in a same platform, the bolt hole specifications, the bolt specifications, the pin hole specifications, the positioning pin specifications, the large through hole specifications, the long bolt hole specifications, the torque specifications, and the sealing member specifications on the crankcase assembly side of the crosshead box assembly in the present disclosure are exactly the same. This is equivalent to that the input side interface of the third module described in the claims is configured in a platform-based manner. In this way, crosshead box assemblies with different specifications can be used for replacement and crankcase assemblies with different specifications can be adapted when the external interfaces are standardized and uniformed.

[4.3 Connections on a Spacer Frame Assembly Side of the Crosshead Box Assembly]

Figure 13A:
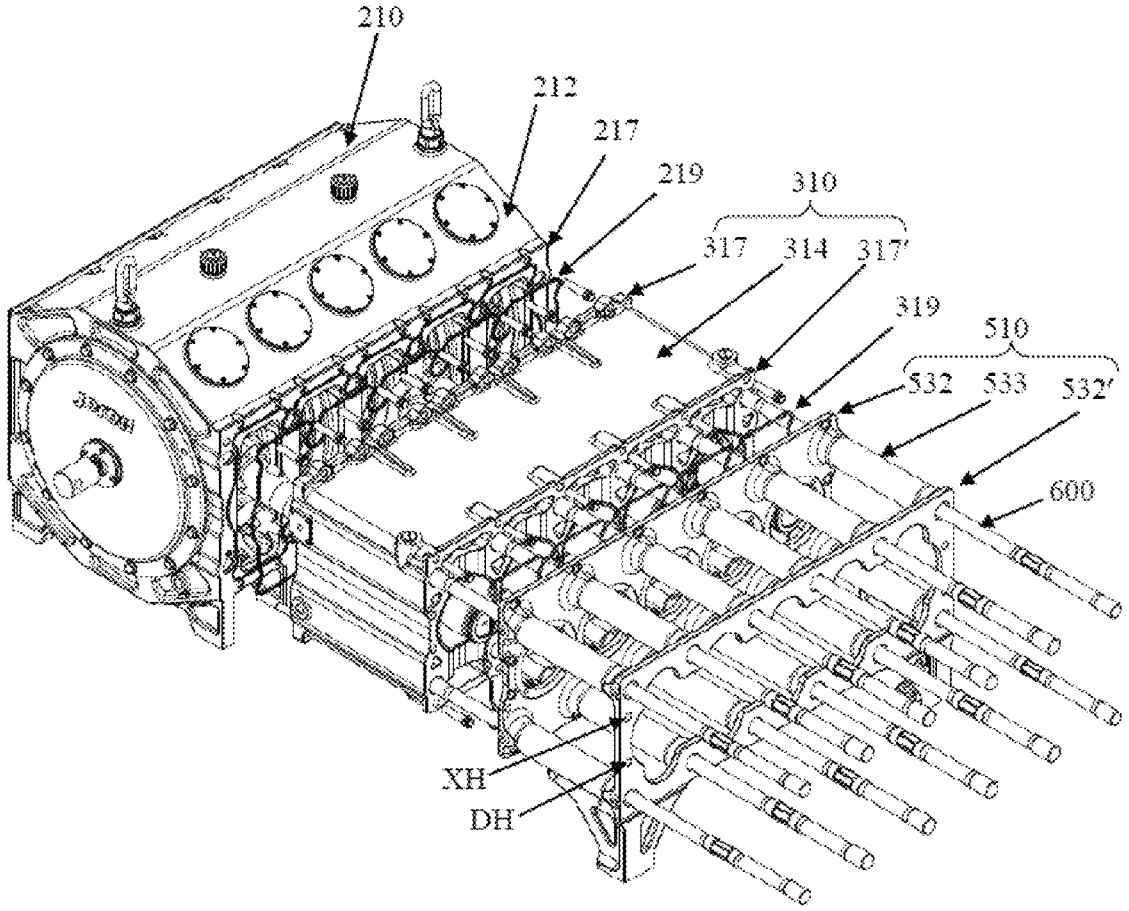
FIG. 13A and FIG. 13B respectively schematically show a disassembly state and a completion state of a connection between a crankcase assembly, a crosshead box assembly, and a spacer frame assembly.

As shown in FIG. 13A, the connection between the crosshead box assembly 310 and the spacer frame assembly 510 is as follows: (1) The long bolts 600 pass through the long bolt holes sH in the spacer frame assembly 510 and the long bolt holes sH in the front end surface 317' of the crosshead box assembly 310 to achieve the first level of connection (overall fastening and pre-tightening). (2) Cylindrical positioning pins pass through the pin holes in the rear end surface 532 of the spacer frame assembly 510 and the corresponding pin holes in the front end surface 317' of the crosshead box assembly 310 to mount and position the rear end surface 532 and the front end surface 317'. Bolts pass through the corresponding bolt holes LH in the rear end surface 532 and the front end surface 317' to fasten the rear end surface 532 and the front end surface 317' together. In addition, the sealing ring 319 forms a sealing connection between the connection surfaces of the rear end surface 532 and the front end surface 317', thereby achieving the second level of connection.

Herein, the large through holes correspondingly provided on the rear end surface 532 and the front end surface 317' are configured to allow reciprocating motion of the pull rod 313 and the plunger 421. In addition, the pin holes on the left and right sides that are correspondingly provided on the rear end surface 532 and the front end surface 317' may be mounted and positioned via positioning pins. Bolt holes on both upper and lower sides and on both left and right sides that are correspondingly provided on the rear end surface 532 and the front end surface 317' may be used to tightly connect the rear end surface 532 and the front end surface 317' via bolts, thereby ensuring that the connection surfaces of the crosshead box assembly 310 and the spacer frame assembly 510 are tightly fitted.

For crosshead box assemblies with different pull rod lengths (corresponding to different strokes of plunger pump products) in a same platform, the large through hole specifications, the long bolt hole specifications, the pin hole specifications, the positioning pin specifications, the bolt hole specifications, the bolt specifications, the torque specifications, and the sealing member specifications on the spacer frame assembly side of the crosshead box assembly in the present disclosure are exactly the same. This is equivalent to that the output side interface of the third module is configured in a platform-based manner. In this way, crosshead box assemblies with different specifications can be used for replacement and spacer frame assemblies with different specifications can be adapted when the external interfaces are standardized and uniformed.

[5. Platform-Based Design of a Fifth Module]

[5.1 Spacer Frame Assembly]

Figure 11:
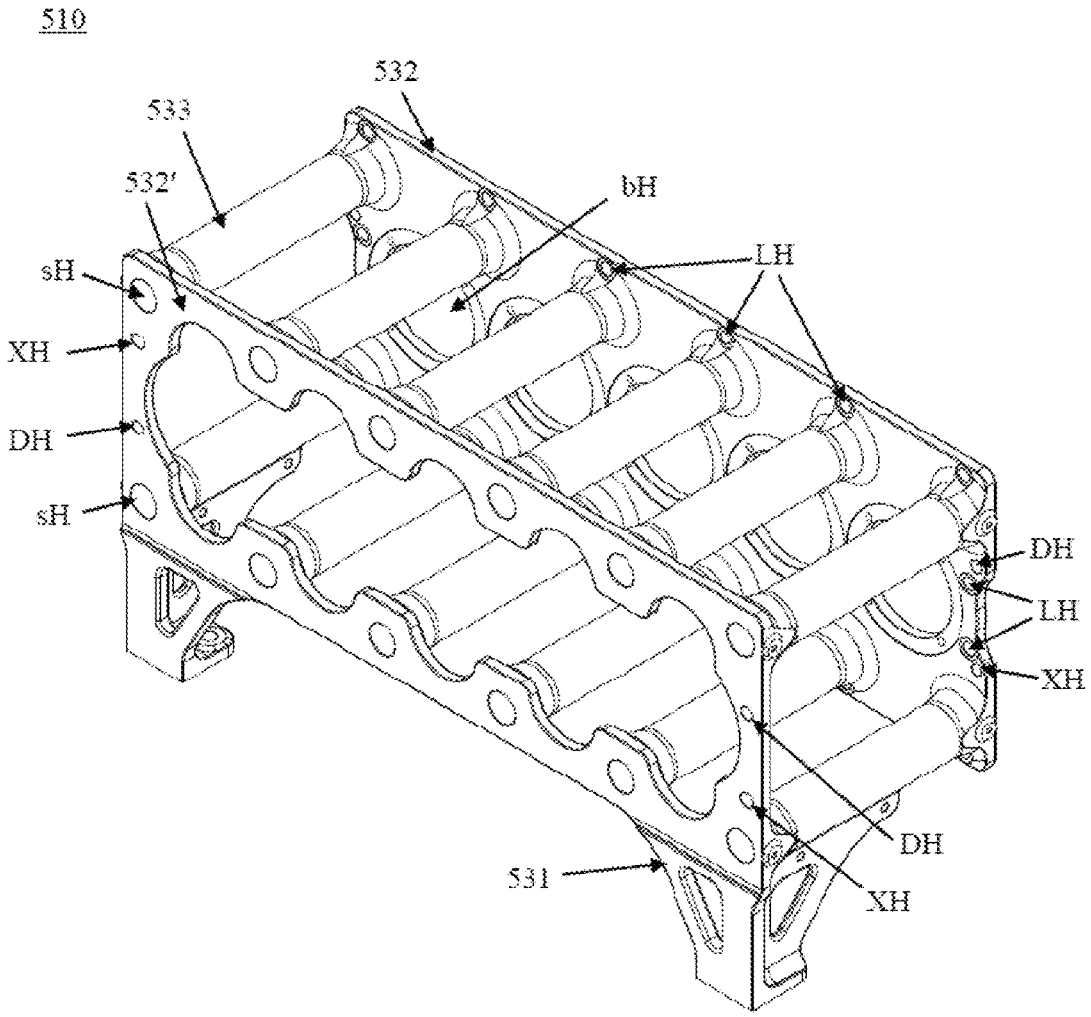
FIG. 11 is a schematic diagram illustrating a configuration example of a spacer frame assembly according to an example embodiment of the present disclosure.

FIG. 11 is a schematic diagram illustrating a configuration example of a spacer frame assembly according to an embodiment of the present disclosure. As shown in FIG. 11, the spacer frame assembly 510 includes a spacer 533. The crosshead box assembly side of the spacer frame assembly 510 has a rear end surface 532 that forms an input port of the spacer frame assembly 510. The fluid end assembly side of the spacer frame assembly 510 has a front end surface 532' that forms an output port of the spacer frame assembly 510. The spacer 533 is securely sandwiched between the rear end surface 532 and the front end surface 532', thereby forming a frame structure. Although FIG. 11 shows that six spacers 533 are evenly arranged in two rows, the present disclosure is not limited thereto, and there may be any quantity (at least two) of spacers 533.

The spacer frame assembly 510 is provided with multiple long bolt holes sH that successively run through the front end surface 532', the spacer 533, and the rear end surface 532 (for example, 6 long bolt holes sH on each of the upper and lower rows). The rear end surface 532 is penetrated by multiple bolt holes LH respectively corresponding to multiple bolt holes on the front end surface 317' (e.g., 6 bolt holes LH on each of the upper and lower edges, and 2 on each of the left and right edges); multiple large through holes bH respectively and generally corresponding to multiple large through holes on the front end surface 317'; and multiple pin holes XH respectively corresponding to multiple pin holes on the front end surface 317' (e.g., 1 pin hole XH on each of the left and right edges). Herein, the large through hole bH may preferably have a specific margin to be compatible with variable designs of different plunger diameters. In addition, one set screw hole DH is provided on each of the left and right edges of the rear end surface 532, which is auxiliary for removal of positioning pins.

In the front end surface 532', a hollowed-out portion is formed according to the contour corresponding to the area occupied by all plungers 421, and may preferably have a specific margin to be compatible with variable designs of different plunger diameters. In addition, one pin hole XH and one set screw hole DH are provided on each of the left and right edges of the front end surface 532'. In addition, although not shown, several bolt holes may be provided on the upper and lower edges as well as the left and right edges of the front end surface 532' (similar to the multiple bolt holes on the rear end surface 532), to achieve a secure connection to the fluid end assembly 410.

The spacer frame assembly 510 is a structural member between the crosshead box assembly 310 and the fluid end assembly 410. Its primary function is to maintain an appropriate distance between the fluid end assembly 410 and the crosshead box assembly 310 based on different plunger strokes, while also providing a maintenance space for components related to the fluid end assembly 410, such as the plunger 421 and packing assembly 424. As described above with reference to FIG. 2A, a support bracket 531 may be arranged beneath the spacer frame assembly 510. The bottom of the support bracket 531 may be connected to the support base 216 of the crankcase assembly 210 (which serves as the base for the entire plunger pump), thereby jointly providing support for the plunger pump (particularly the fluid end assembly side).

In the present disclosure, the spacer frame assembly may have different length specifications in a range of 6 in to 12 in depending on different strokes of the plunger. As described later in this specification, two length specifications A-8 in and B-10 in are used as examples.

[5.2 Connections on a Crosshead Box Assembly Side of the Spacer Frame Assembly]

As shown in FIG. 13A, the connection between the spacer frame assembly 510 and the crosshead box assembly 310 is as follows: (1) The long bolts 600 may pass through the long bolt holes sH in the spacer frame assembly 510 and the long bolt holes sH in the crosshead box assembly 310, thereby achieving overall fastening and pre-tightening. (2) Cylindrical positioning pins are used to pass through the pin holes XH on the rear end surface 532 of the spacer frame assembly 510 and the corresponding pin holes XH on the front end surface 317' of the crosshead box assembly 310 to mount and position the rear end surface 532 and the front end surface 317'. Bolts are then used to pass through the corresponding bolt holes on the rear end surface 532 and the front end surface 317', fastening them securely. In addition, a sealing ring 319 is used between the rear end surface 532 and the front end surface 317' to provide a sealing connection.

By using the cylindrical positioning pins and the pin holes on the corresponding left and right edges of the rear end surface 532 and the front end surface 317', mounting and positioning between the spacer frame assembly 510 and the crosshead box assembly 310 can be ensured. By using bolts and the upper and lower rows of bolt holes, as well as the bolt holes on the left and right sides of both the rear end surface 532 and the front end surface 317', thereby ensuring that the connection surfaces of the spacer frame assembly 510 and the crosshead box assembly 310 are tightly fitted. The sealing connection by the sealing ring 319 prevents leakage of lubricating oil from the crosshead box assembly 310 and prevents external water, air, dust, and other contaminants from entering the crosshead box assembly 310.

For spacer frame assemblies with different lengths in a same platform, the large through hole specifications, the long bolt hole specifications, the pin hole specifications, the positioning pin specifications, the bolt hole specifications, the bolt specifications, the torque specifications, and the sealing member specifications on the crosshead box assembly side of the spacer frame assembly in the present disclosure are exactly the same. This is equivalent to that the input side interface of the fifth module is configured in a platform-based manner. In this way, spacer frame assemblies with different specifications can be used for replacement and crosshead box assemblies with different specifications can be adapted when the external interfaces are standardized and uniformed.

[5.3 Connections on a Fluid End Assembly Side of the Spacer Frame Assembly]

Figure 13B:
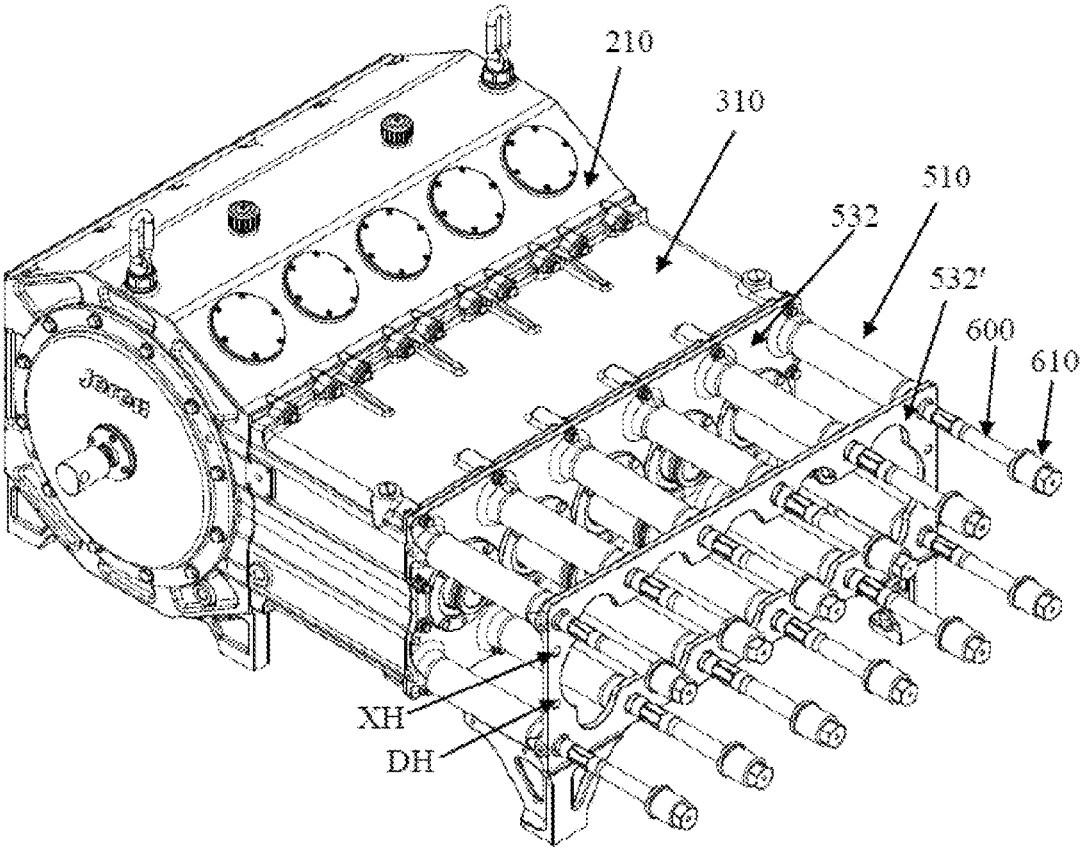

As shown in FIG. 13B (a diagram where the fluid end assembly 410 is omitted), when the spacer frame assembly 510 is connected to the fluid end assembly 410, long bolts 600 run through long bolt holes in the fluid end assembly 410 and long bolt holes in the spacer frame assembly 510, thereby achieving overall fastening and pre-tightening.

In addition, when the spacer frame assembly 510 is connected to the fluid end assembly 410, pin holes XH provided on the left and right edges of the front end surface 532' of the spacer frame assembly 510 and corresponding positioning pins (not shown) provided on the left and right edges of a backplate 426 of the fluid end assembly 410 are used to achieve mounting and positioning between the front end surface 532' of the spacer frame assembly 510 and the backplate 426 of the fluid end assembly 410. The bolt holes on the upper, lower, left, and right edges of the front end surface 532' of the spacer frame assembly 510, the corresponding bolt holes on the backplate 426 of the fluid end assembly 410, and the bolts are used to achieve a fastening connection between the spacer frame assembly 510 and the fluid end assembly 410. In addition, a sealing connection between the front end surface 532' of the spacer frame assembly 510 and the end surface of the backplate 426 of the fluid end assembly 410 may also be achieved by using the sealing member as described previously.

For spacer frame assemblies with different lengths in a same platform, the pin hole specifications, the positioning pin specifications, the bolt hole and bolt specifications, the long bolt hole specifications, the torque specifications, and the sealing member specifications on the fluid end assembly side of the spacer frame assembly in the present disclosure are exactly the same. This is equivalent to that the output side interface of the fifth module is configured in a platform-based manner. In this way, spacer frame assemblies with different specifications can be used for replacement and fluid end assemblies with different specifications can be adapted when the external interfaces are standardized and uniformed.

[6. Platform-Based Design of a Fourth Module]

[6.1 Fluid End Assembly]

Figure 12A:
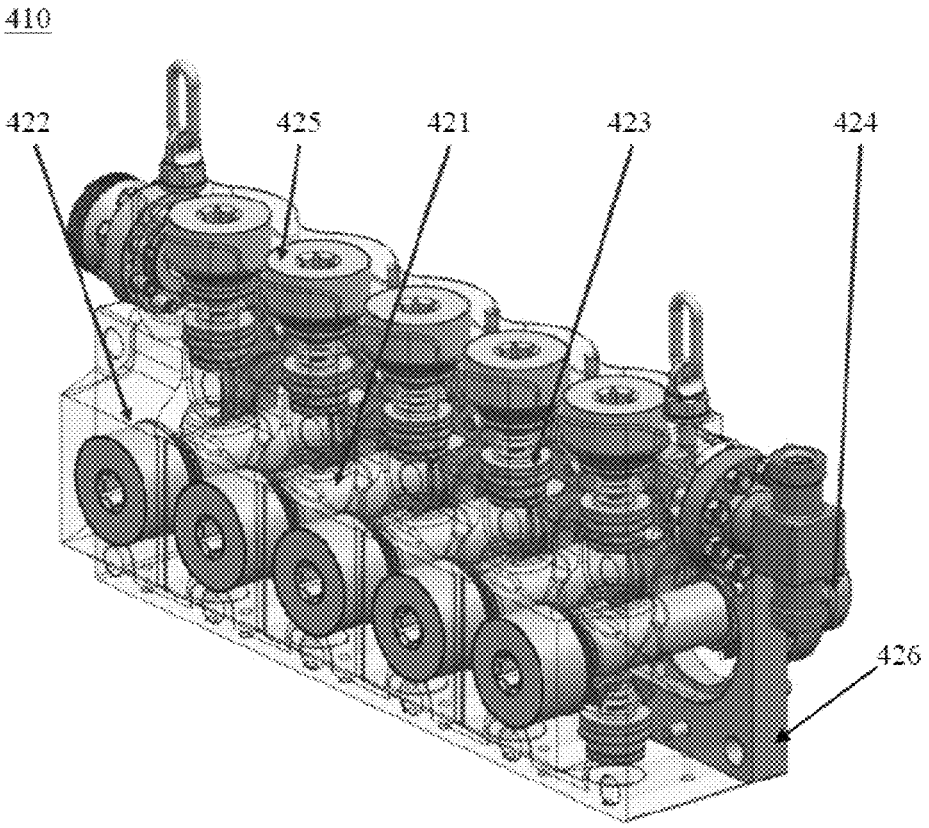
FIG. 12A and FIG. 12B are respectively a perspective view of a configuration example of a fluid end assembly according to an example embodiment of the present disclosure and a side plan view when viewed in an arrangement direction of a plunger.
Figure 12B:
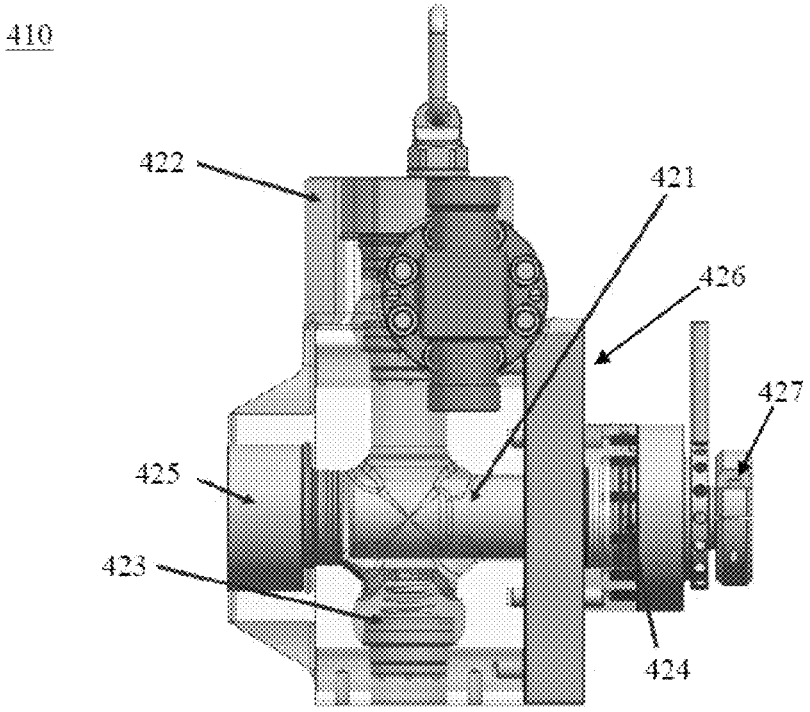

FIG. 12A and FIG. 12B are respectively a perspective view of a configuration example of a fluid end assembly according to an embodiment of the present disclosure and a side plan view when viewed in an arrangement direction of a plunger. The fluid end assembly 410 mainly includes components such as a plunger 421, a valve box 422, a valve assembly 423, a packing assembly 424, and a gland nut assembly 425. The function of the fluid end assembly 410 is as follows: The reciprocating motion of the plunger 421 causes a change in the volume of the cavity in the valve box 422, thereby achieving suction and discharge of liquid media such as fracturing fluid. The packing assembly 424 serves as a seal to prevent liquid media from leaking around the plunger. The upper and lower valve assemblies 423 are configured to control the flow direction of the liquid media, ensuring unidirectional flow of the liquid media from the suction end connected to the inlet pipe assembly to the discharge end connected to the outlet pipe assembly, thus preventing backflow of the liquid media.

A long bolt hole that allows the long bolt 600 to run through is arranged in the fluid end assembly 410. In addition, a backplate 426 is arranged on one side of the fluid end assembly 410 facing toward the spacer frame assembly 510, and forms a plunger side port of the fluid end assembly 410. Multiple (not limited to 5 shown in the present disclosure) plungers 421 may be arranged in the fluid end assembly 410. The plunger 421 is driven by the crosshead 311 and the pull rod 313 to perform reciprocating motion to enter and exit the cavity of the valve box 422. In the present disclosure, the plunger of the fluid end assembly may have different plunger diameter specifications within a range of 2.5 in to 6 in. As described later in this specification, two diameter specifications A-4 in and B-4.5 in are used as examples.

[6.2 Connections on a Spacer Frame Assembly Side of the Fluid End Assembly]

Multiple pin holes (a quantity of at least 2) are provided in the backplate 426 of the fluid end assembly 410, and cylindrical positioning pins are respectively fastened in the pin holes. In addition, multiple bolt holes (a quantity of at least 2) are further provided in the backplate 426 of the fluid end assembly 410, and bolts are respectively fastened in the bolt holes. Referring to FIG. 12B and FIG. 13A, the backplate 426 of the fluid end assembly 410 is mounted and positioned on the front end surface 532' of the spacer frame assembly 510 via multiple cylindrical positioning pins arranged on the backplate 426 of the fluid end assembly 410 and multiple pin holes XH arranged on the front end surface 532' of the spacer frame assembly 510. The bolt holes on the backplate 426 are fastened and connected to the corresponding bolt holes in the front end surface 532' of the spacer 510 via bolts. In addition, the sealing member as described above may also be arranged between the fluid end assembly 410 and the spacer frame assembly 510.

Note that, in a case in which the spacer frame assembly 510 is not arranged, the multiple pin holes and the multiple bolt holes provided in the front end surface 317' of the crosshead box assembly 310 described above may be respectively used as positioning holes for mounting and positioning the multiple cylindrical positioning pins on the backplate 426 of the fluid end assembly 410 and mounting holes for fastening and connecting the multiple bolt holes on the backplate 426.

In addition, when the fluid end assembly 410 is connected to the spacer frame assembly 510, one end of the long bolt 600 passes through the fluid end assembly 410, the spacer frame assembly 510, and the crosshead box assembly 310, and is screwed into the crankcase assembly 210. Then, the other exposed end of the long bolt 600 outside the fluid end assembly 410 is fastened with a fastening nut 610, thereby achieving a physical connection through a rigid sealing structure.

As shown in FIG. 1B, the plunger 421 in the fluid end assembly 410 is connected to the pull rod 313 in the crosshead box assembly 310 through a hoop 427 at the frame structure of the spacer frame assembly 510, so as to transfer reciprocating motion power from the crosshead 311 to the plunger 421 via the pull rod 313. In the absence of the pull rod 313, the plunger 421 is directly connected to the crosshead 311.

For fluid end assemblies with different plunger specifications in a same platform, the pin hole specifications, the positioning pin specifications, the bolt hole and bolt specifications, the long bolt hole specifications, the torque specifications, and the sealing member specifications on the spacer frame assembly side of the fluid end assembly in the present disclosure are exactly the same. This is equivalent to a platform-based design of the input side interface of the fourth module. In this way, fluid end assemblies with different specifications can be used for replacement and spacer frame assemblies with different specifications can be adapted when the external interfaces are standardized and uniformed.

[6.3 Connections on Other Sides of the Fluid End Assembly]

A suction end configured to connect to the inlet pipe assembly and a discharge end configured to connect to the outlet pipe assembly are arranged at different parts of the fluid end assembly 410 from the plunger outlet/input side. For fluid end assemblies 410 with different specifications, each of the suction end and the discharge end may be configured in a platform-based manner, so that the inlet pipe assembly and the outlet pipe assembly can still be adapted when fluid end assemblies 410 with different specifications are used for replacement. As an example, the suction end and the discharge end may also be compatible with interface position changes caused by the replacement of fluid end assemblies with different specifications through a matching flexible design.

[7. Different Combination Manners of the Split-Type Plunger Pump Component][7.1 Different Combination Manners]

In conclusion, at any connection portion in the split-type plunger pump of the present disclosure, even when assemblies with different specifications are used for replacement, their external interfaces are fully uniformed. On this basis, the present disclosure provides a split-type plunger pump component having external interfaces configured in a platform-based manner. Through combinations of components with different specifications, plunger pump products with different performance parameters can be combined, so that they are applicable to different applications, and product-to-product conversion can be implemented by replacing at least one assembly.

For example, the present disclosure exemplifies combinations of the following main specifications:

① Plunger diameter of the fluid end assembly—different diameter specifications in the range of 2.5 in to 6 in (two diameter specifications A-4 in and B-4.5 in are exemplified in this specification)

② Length of the spacer of the spacer frame assembly—different length specifications in the range of 6 in to 12 in (corresponding to the stroke of the plunger pump, and two length specifications A-8 in and B-10 in are exemplified in this specification)

③ Length of the pull rod of the crosshead box assembly—different length specifications in the range of 6 in to 12 in (corresponding to the stroke of the plunger pump, and two length specifications A-8 in and B-10 in are exemplified in this specification)

④ Crank throw of the crankshaft of the crankcase assembly—different length specifications in the range of 6 in to 12 in (corresponding to the stroke of the plunger pump, and two length specifications A-8 in and B-10 in are exemplified in this specification)

⑤ Reduction structure and gear ratio of the reduction gearbox assembly—two structural types, a single parallel-stage (A) reduction structure and a parallel and planetary two-stage (B) reduction structure, and different gear ratios in the range of 5:1 to 15:1 (three gear ratios a=6.353:1, b=7.8:1, and c=13:1 are exemplified in this specification)

Figure 14:
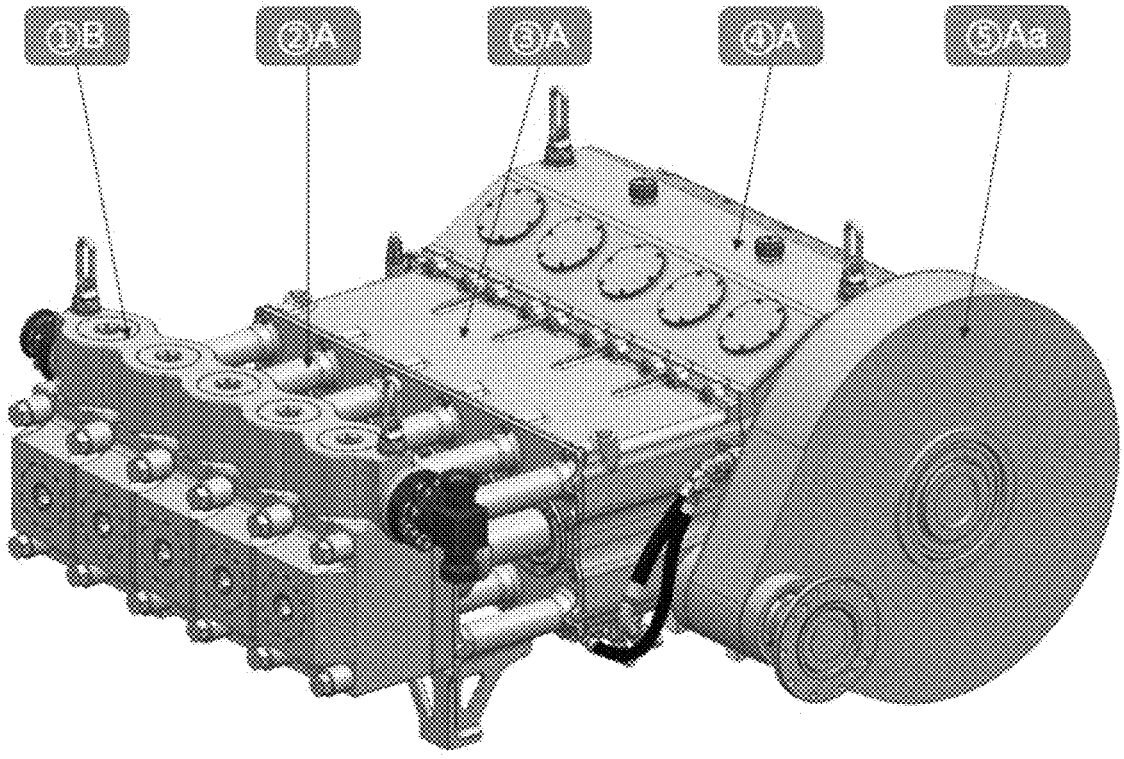
FIG. 14 is a three-dimensional view illustrating Product 1 obtained by combining split-type plunger pump components with different specifications according to an example embodiment of the present disclosure.

Later, the following products obtained by combining components with different specifications will be exemplified:

Product 1: As shown in FIG. 14, using the combination of ①B+②A+③A+④A+⑤Aa, the resulting product is a plunger pump with a rated input power of 2800 bhp, a stroke of 8 in, a plunger diameter of 4.5 in, a single parallel-stage reduction structure, and a gear ratio of 6.353:1, and is suitable for fuel engine-driven scenarios that have high lightweight (weight reduction) requirements.

Figure 15:
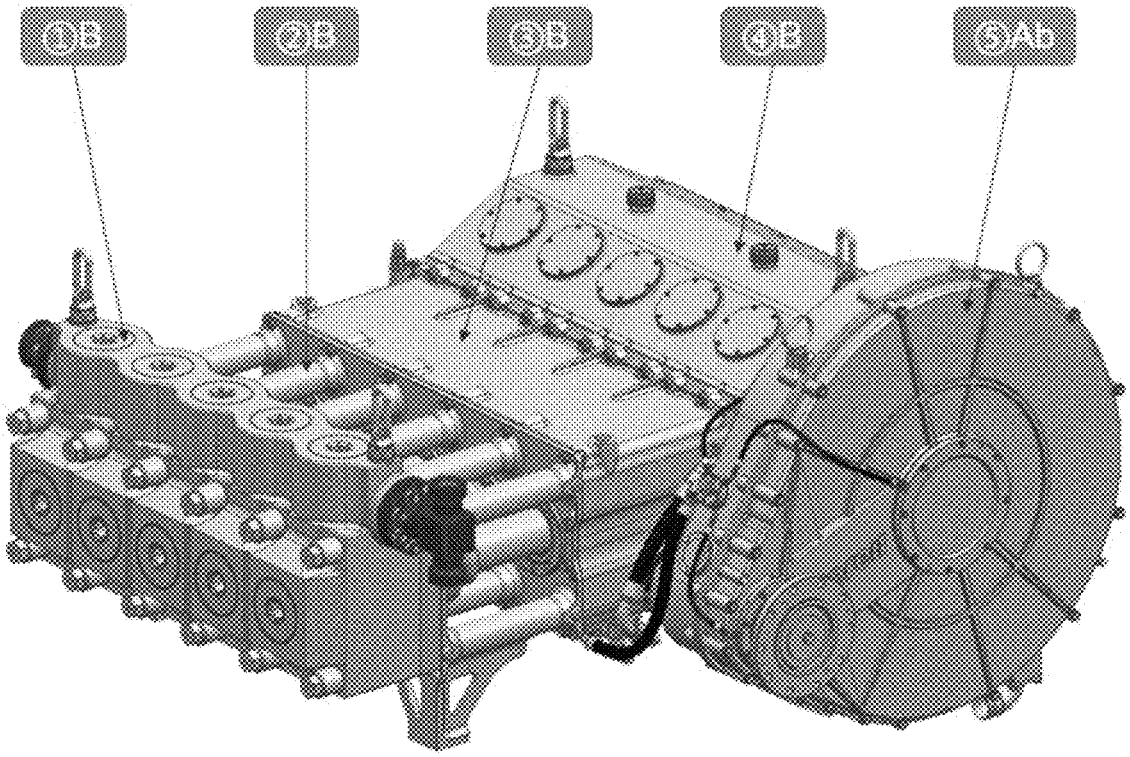
FIG. 15 is a three-dimensional view illustrating Product 2 obtained by combining split-type plunger pump components with different specifications according to an example embodiment of the present disclosure.

Product 2: As shown in FIG. 15, using the combination of ①B+②B+③B+④B+⑤Ab, the resulting product is a plunger pump with a rated input power of 3500 bhp, a stroke of 10 in, a plunger diameter of 4.5 in, a single parallel-stage reduction structure, and a gear ratio of 7.8:1, and is suitable for fuel engine-driven scenarios that have high operational displacement requirements (such as larger, more stable operational displacement or higher operational efficiency).

Figure 16:
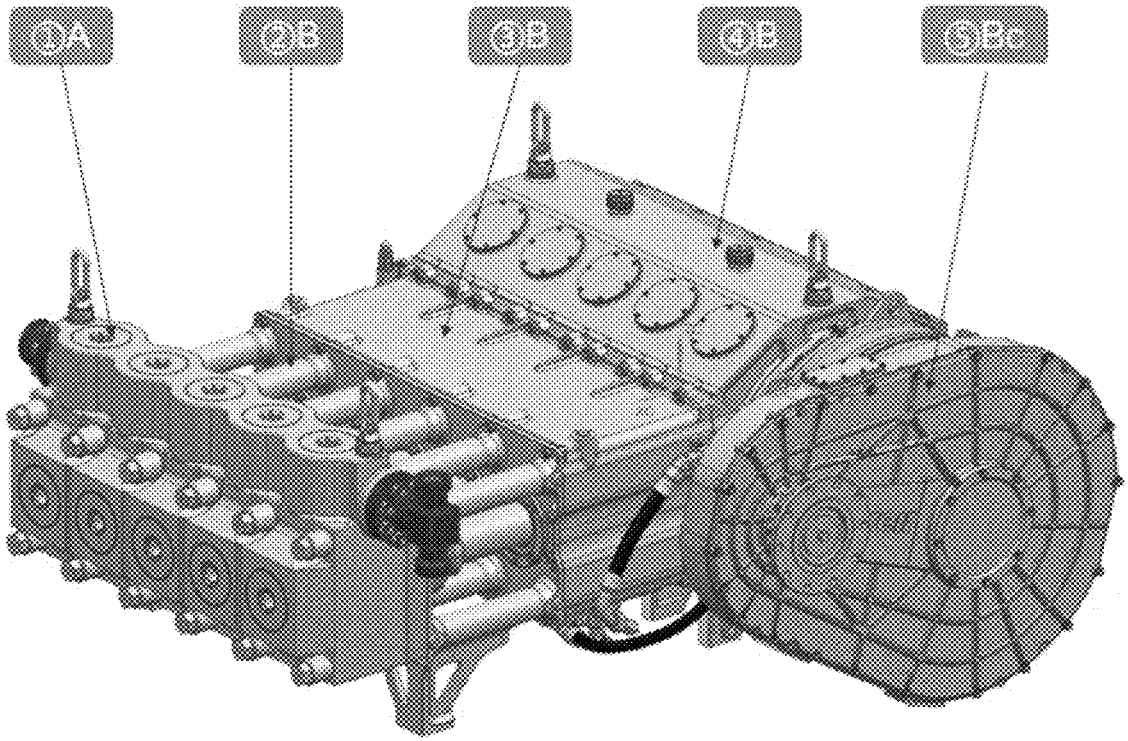
FIG. 16 is a three-dimensional view illustrating Product 3 obtained by combining split-type plunger pump components with different specifications according to an example embodiment of the present disclosure.

Product 3: As shown in FIG. 16, using the combination of ①A+②B+③B+④B+⑤Bc, the resulting product is a plunger pump with a rated input power of 4500 bhp, a stroke of 10 in, a plunger diameter of 4 in, a parallel and planetary two-stage reduction structure, and a gear ratio of 13:1, and is suitable for electric motor-driven scenarios that have heavy load and ultra-high pressure working conditions (such as working conditions where the plunger pump can operate at high discharge pressure above 100 MPa for a long time).

In addition to the above three examples, different products can also be configured by combining various components with different specifications, as shown in Table 1 below.

TABLE 1

Examples of other products obtained by combining components with different specifications

| Sequence numbers | Fluid end assembly (Plunger diameter) | Spacer frame assembly (Length of spacer) | Crosshead box assembly (Length of pull rod) | Crankcase assembly (Crank throw of crankshaft) | Reduction gearbox assembly (Reduction structure, gear ratio) | Product description |
|---|---|---|---|---|---|---|
| 1 | 4 in or 4.5 in | 8 in | 8 in | 8 in | 1P, 7.8:1 | Maximum power of 3000 bhp, diesel engine driven-application |
| 2 | 4 in or 4.5 in | 8 in | 8 in | 8 in | 2P, 7.8:1 | Maximum power of 3300 bhp, diesel engine driven-application |
| 3 | 4 in or 4.5 in | 10 in | 10 in | 10 in | 2P, 7.8:1 | Maximum power of 4000 bhp, diesel engine driven-application |
| 4 | 4.5 in or 5 in | 10 in | 10 in | 10 in | 2P, 12.3:1 | Maximum power of 6000 bhp, electric motor driven-application |
| 5 | 4.5 in or 5 in | 11 in | 11 in | 11 in | 2P, 12.3:1 | Maximum power of 7000 bhp, electric motor driven-application |
| . . . | . . . | . . . | . . . | . . . | . . . | . . . |

[7.2 Examples of Replacement Between Different Combination Manners]

By platformizing and standardizing the interface design of each module of the plunger pump product, users can quickly replace different specifications of each module when facing different application working conditions. For example:

(i) When the prime mover is switched from a diesel engine or gas engine to an electric motor, because the input rotational speed of the prime mover increases, the plunger pump can meet the use requirements by simply using a reduction gearbox assembly with a higher gear ratio for replacement. The replacement of the reduction gearbox assembly may involve changing from a single parallel-stage reduction gearbox assembly to another single parallel-stage reduction gearbox assembly with a higher gear ratio, or changing a single parallel-stage reduction gearbox assembly to a parallel and planetary dual-stage reduction gearbox assembly, or converting into a dual-stage reduction gearbox assembly with a higher gear ratio by only replacing a parallel-stage portion of a parallel and planetary dual-stage reduction gearbox assembly.

(ii) When operating duration changes from intermittent operation to continuous operation, which requires higher continuous operation reliability, conversion from light-load to heavy-load working conditions can be achieved by replacing a single parallel-stage reduction gearbox assembly with a parallel and planetary dual-stage reduction gearbox assembly.

(iii) When operating pressure changes from low-pressure operation to high-pressure operation, this can be achieved via a fluid end assembly with a smaller diameter plunger for replacement.

For the above three examples, when switching from Product 2 to Product 3 (i.e., replacing ① B and ⑤ Ab from Product 2 shown in FIG. 15 with ① A and ⑤ Bc from Product 3 shown in FIG. 16), the specific operation is as follows:

(1) In Product 2 as shown in FIG. 15, 5 hoops that respectively connect 5 plungers to 5 pull rods are detached, as shown in FIG. 1B.

Figure 17A:
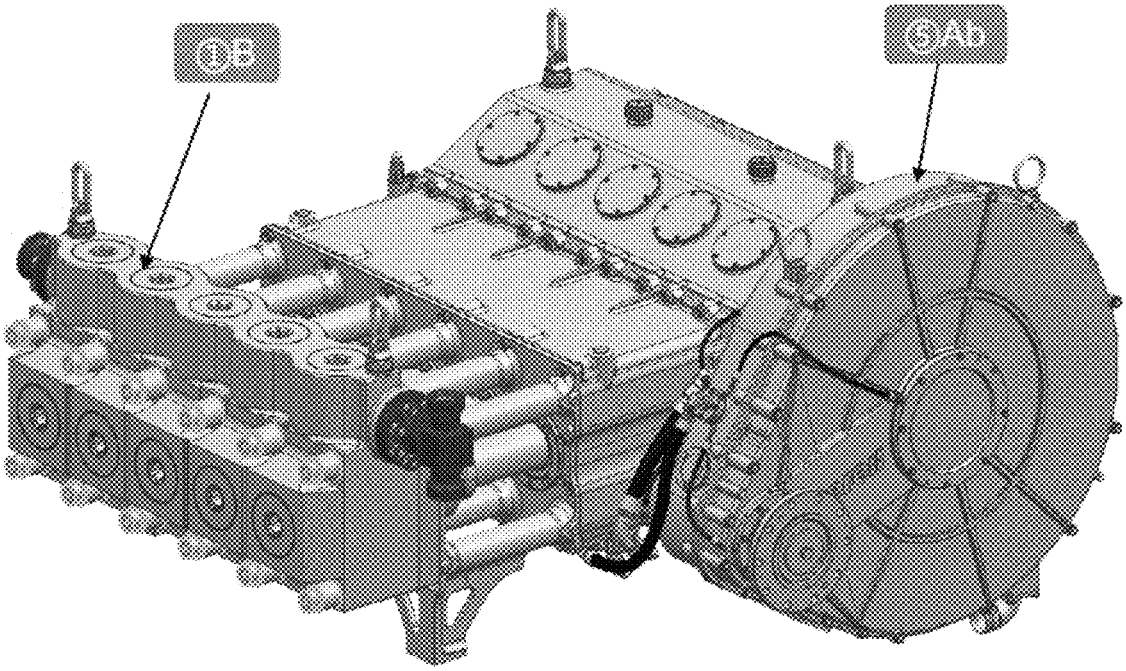
FIG. 17A to FIG. 21 show steps of replacing a fluid end assembly with a fluid end assembly with another specification when Product 2 is replaced with Product 3.

(2) As shown in FIG. 17A, fastening nuts of 12 long bolts are loosened from the outside of the fluid end assembly ① B by using tools such as a wrench.

Figure 17B:
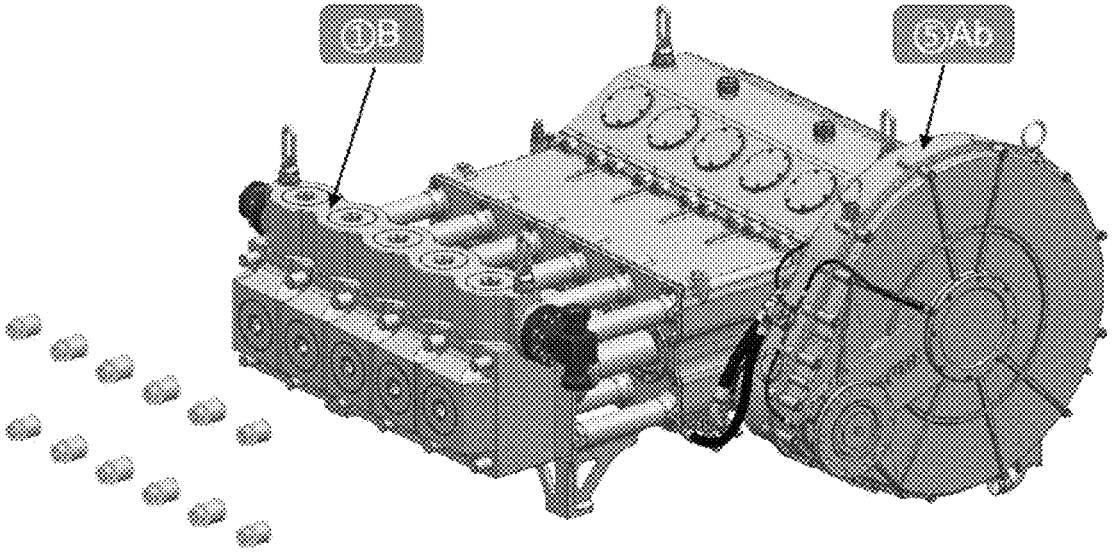

(3) As shown in FIG. 17B, the fastening nuts of the 12 long bolts are removed.

Figure 18A:
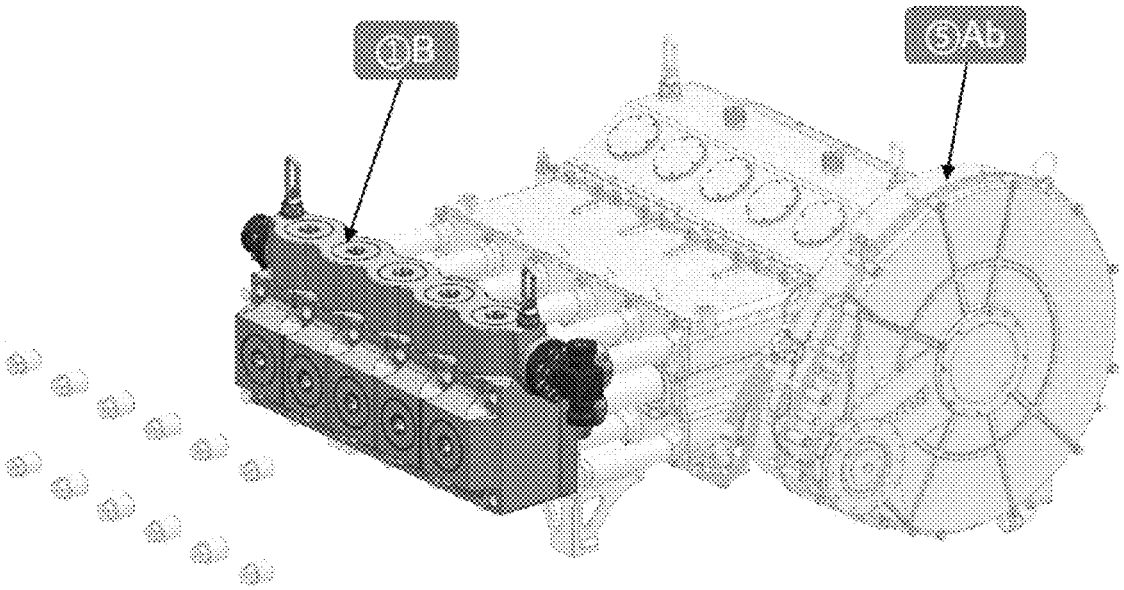
Figure 18B:
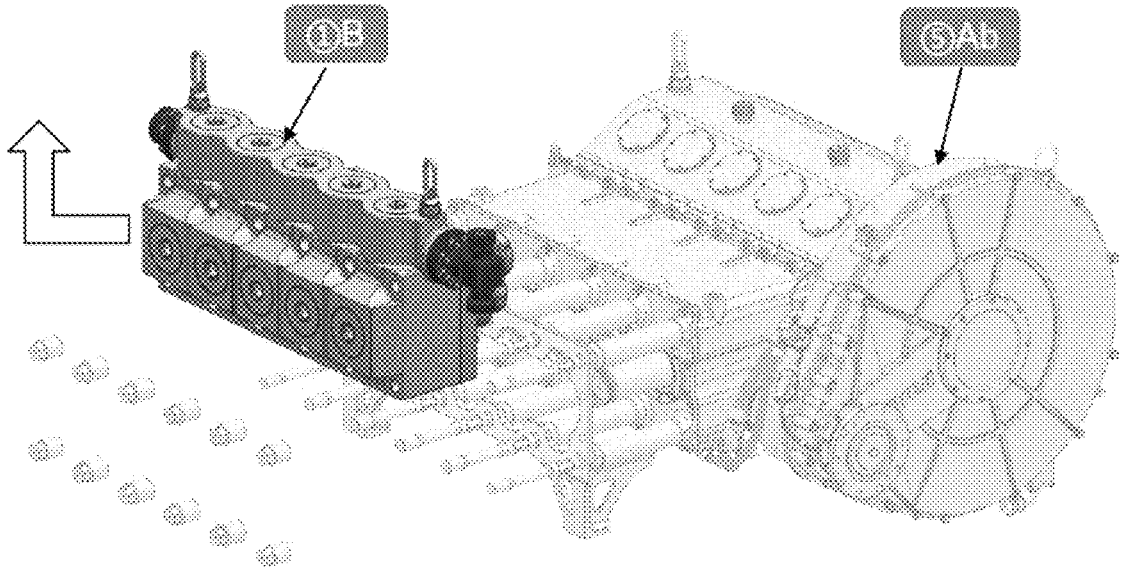
Figure 19A:
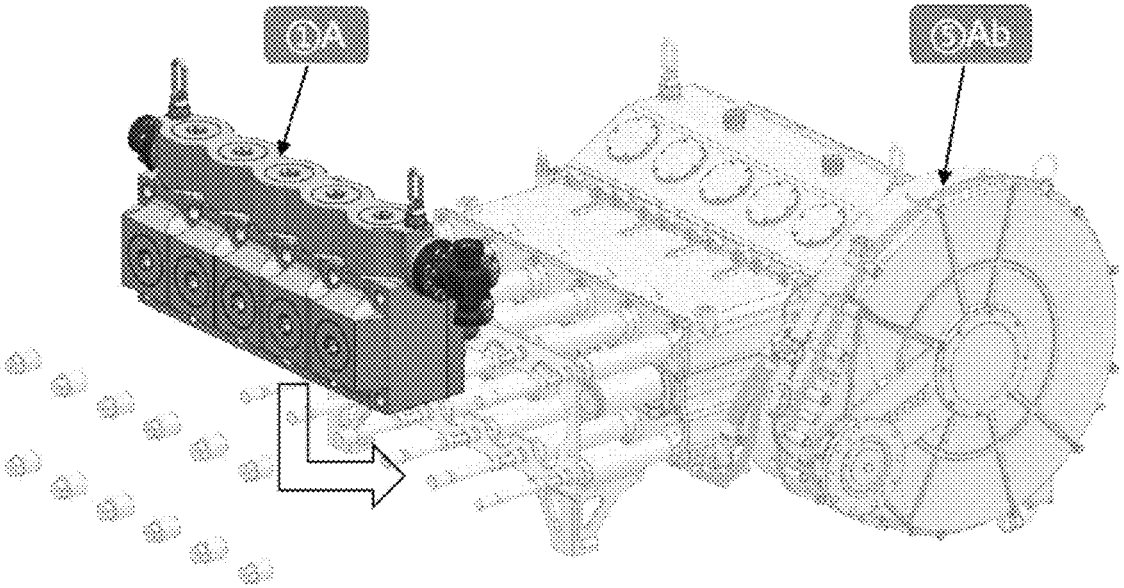
Figure 19B:
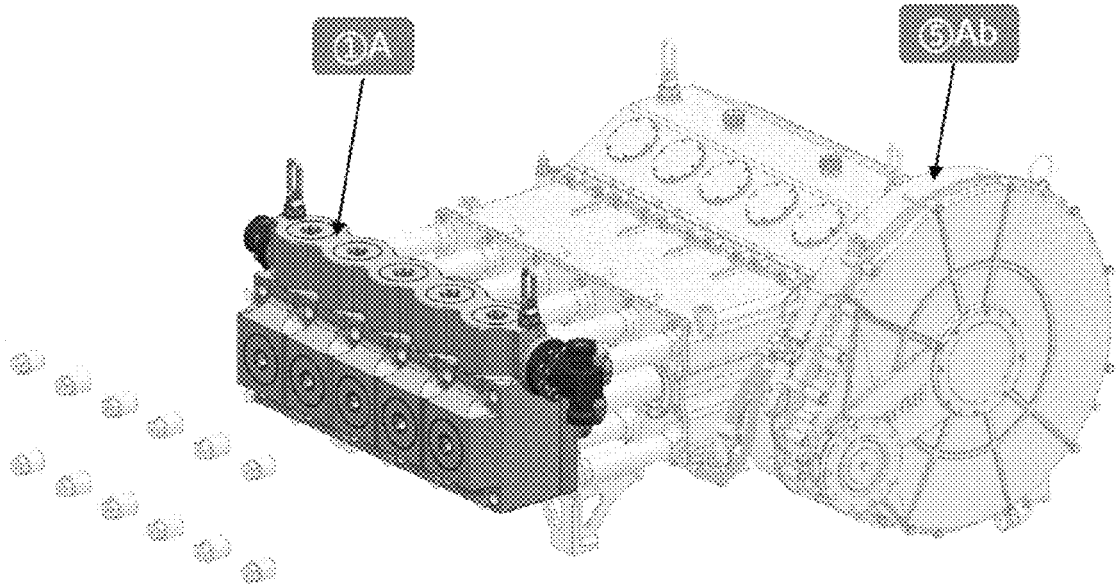

(4) As shown in FIG. 18A and FIG. 18B, the fluid end assembly ① B is removed from the long bolts and taken away (for example, lift). Then, as shown in FIG. 19A and FIG. 19B, the fluid end assembly ① A is moved in and mounted on the 12 long bolts.

Figure 20A:
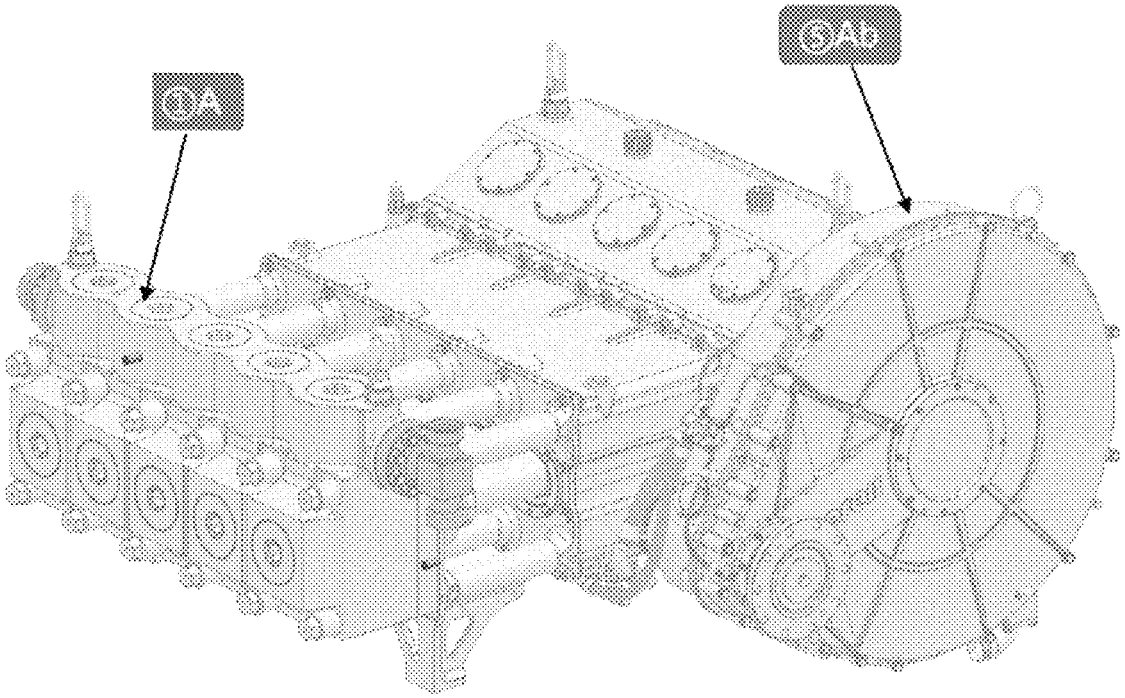

(5) As shown in FIG. 20A, positioning is performed via at least 2 positioning pins arranged on the fluid end assembly ① A and at least 2 pin holes provided on the spacer frame assembly, to ensure that both the fluid end assembly ① A and the spacer frame assembly are positioned and mounted by pairing mounting between the positioning pins and the pin holes. Then, fastening nuts are respectively mounted on the exposed end portions of the 12 long bolts.

Figure 20B:
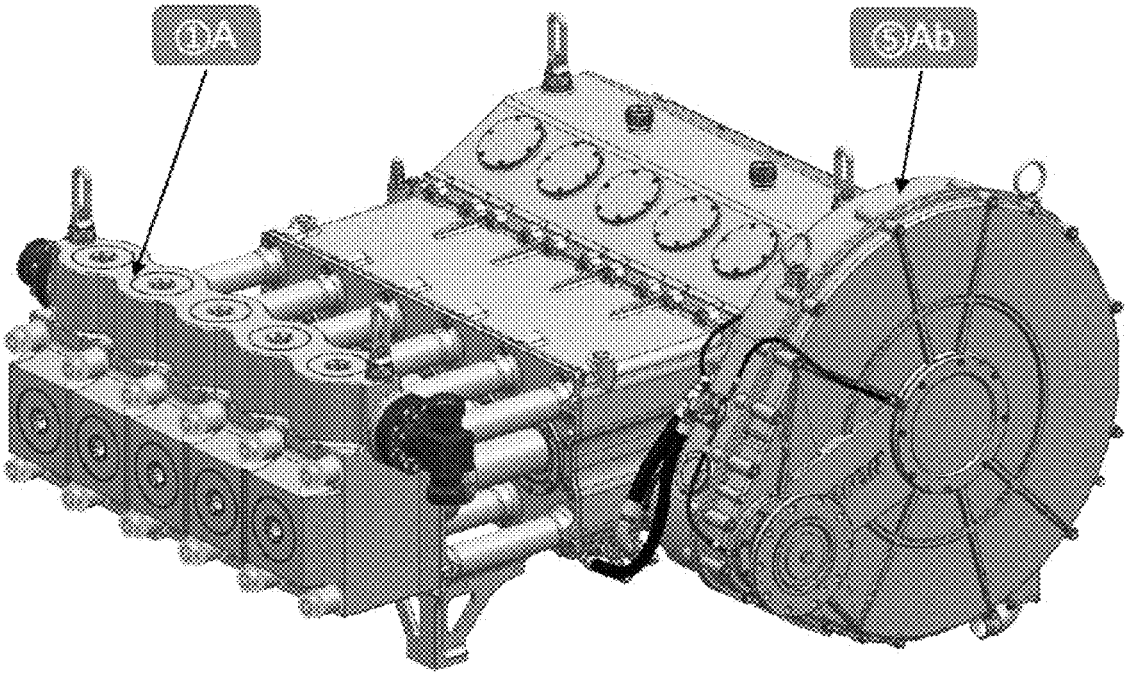

(6) As shown in FIG. 20B, the fastening nuts of the 12 long bolts are tighten to ensure a stable and reliable connection.

Figure 21:
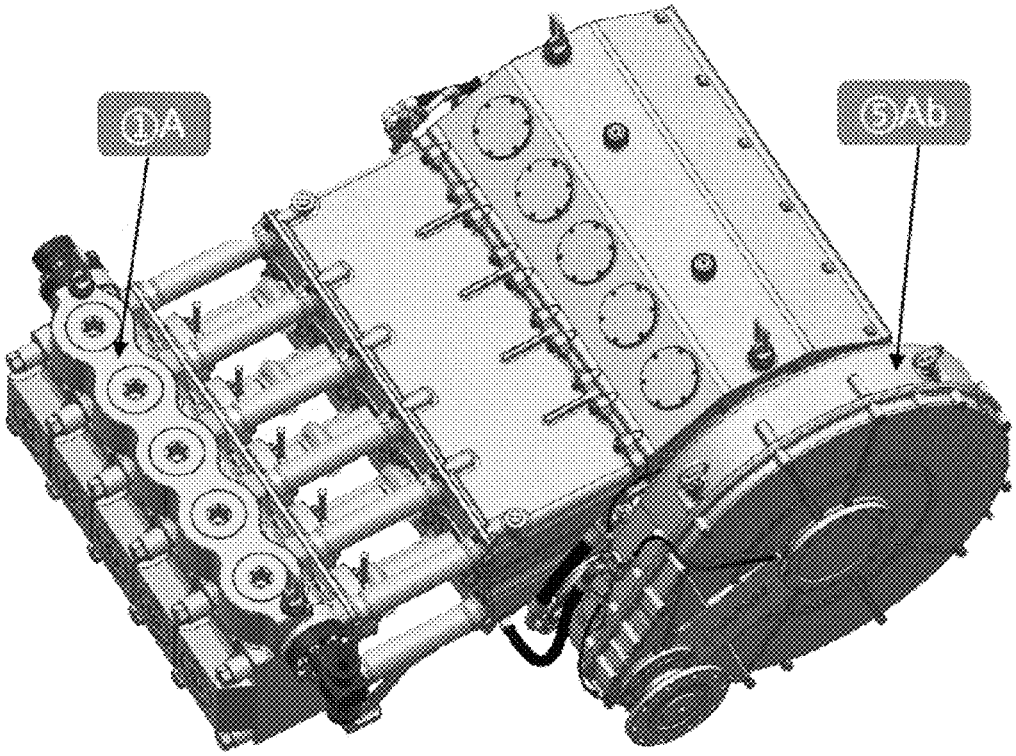

(7) As shown in FIG. 21, 5 hoops are mounted, so that the plunger of the fluid end assembly LA is connected to the pull rod of the crosshead box assembly. So far, replacing the fluid end assembly from ① B with ① A is completed.

Figure 22:
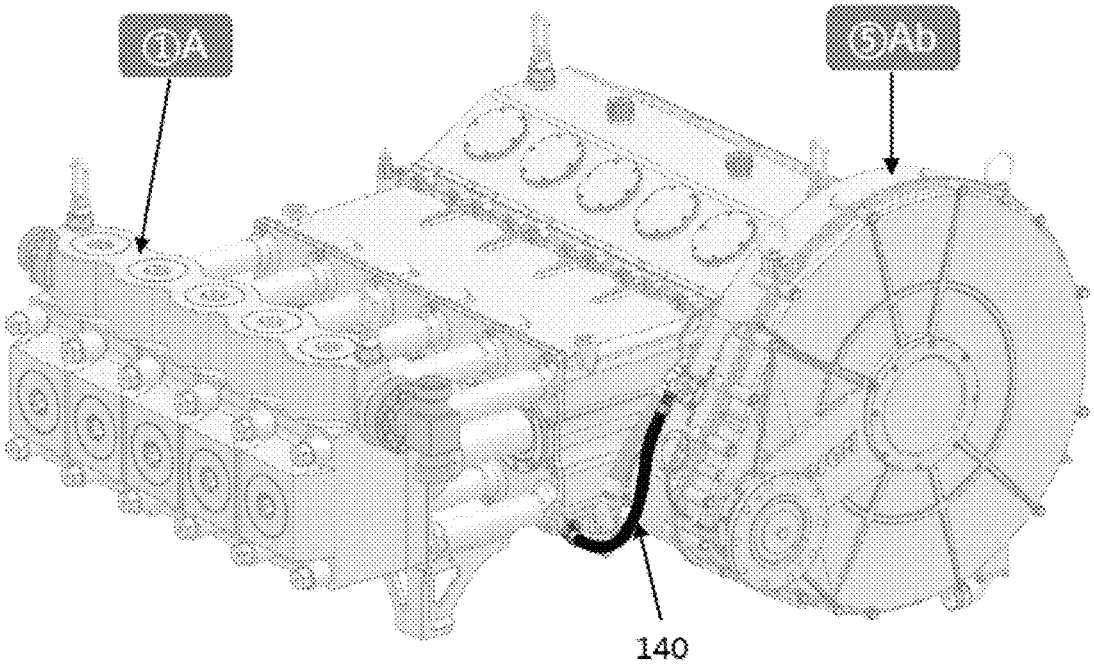
FIG. 22 to FIG. 31 show steps of replacing a reduction gearbox assembly with a reduction gearbox assembly with another specification when Product 2 is replaced with Product 3.

(8) As shown in FIG. 22, a lubricating oil supply pipe 140 is detached from the reduction gearbox assembly ⑤ Ab.

Figure 23:
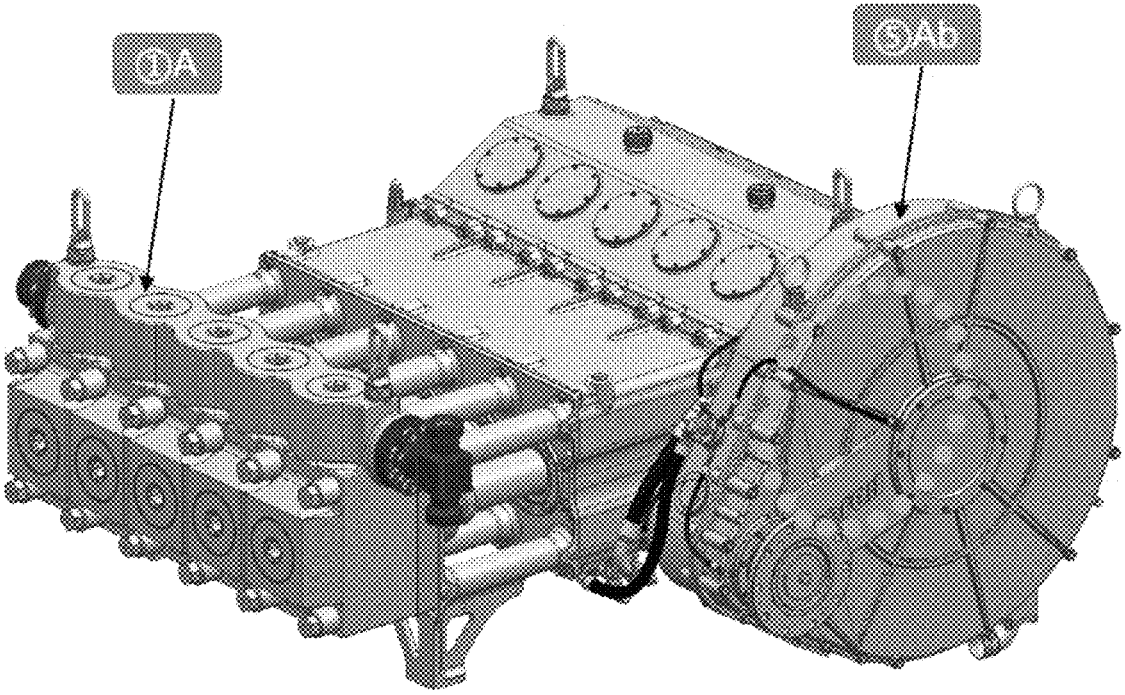

(9) As shown in FIG. 23, all the nuts around the circumference of the second end of the mounting flange of the reduction gearbox assembly ⑤ Ab are unscrewed.

Figure 24:
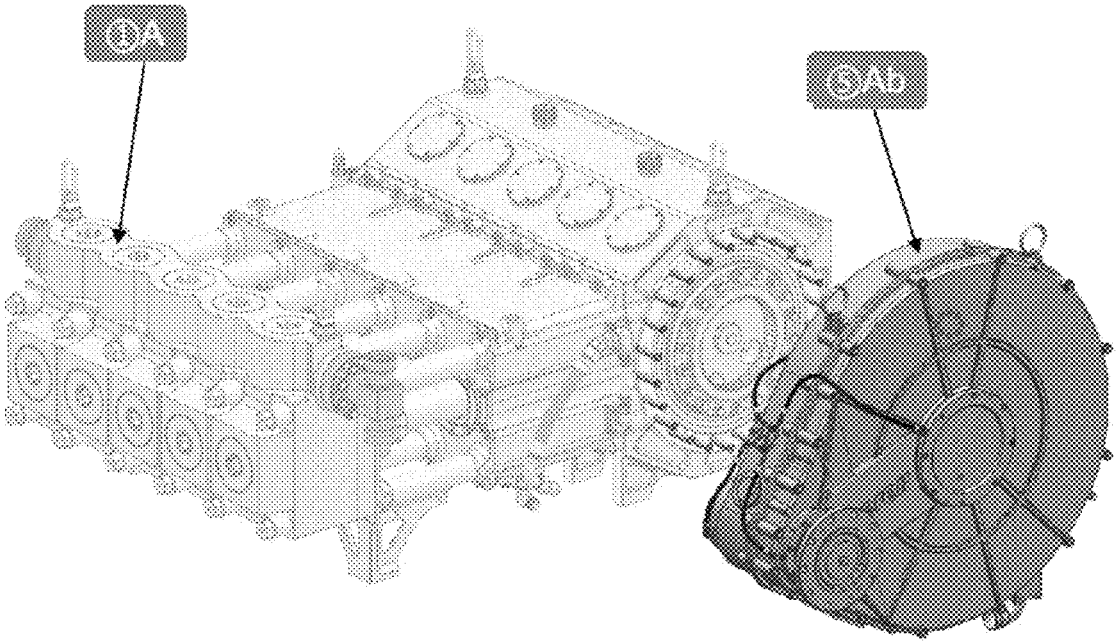

(10) As shown in FIG. 24, the reduction gearbox assembly ⑤ Ab (with the mounting flange) is removed from the double-ended studs at the input port of the crankcase assembly (these double-ended studs are screwed and fastened into multiple positioning holes provided on the input port of the crankcase assembly).

Figure 25:
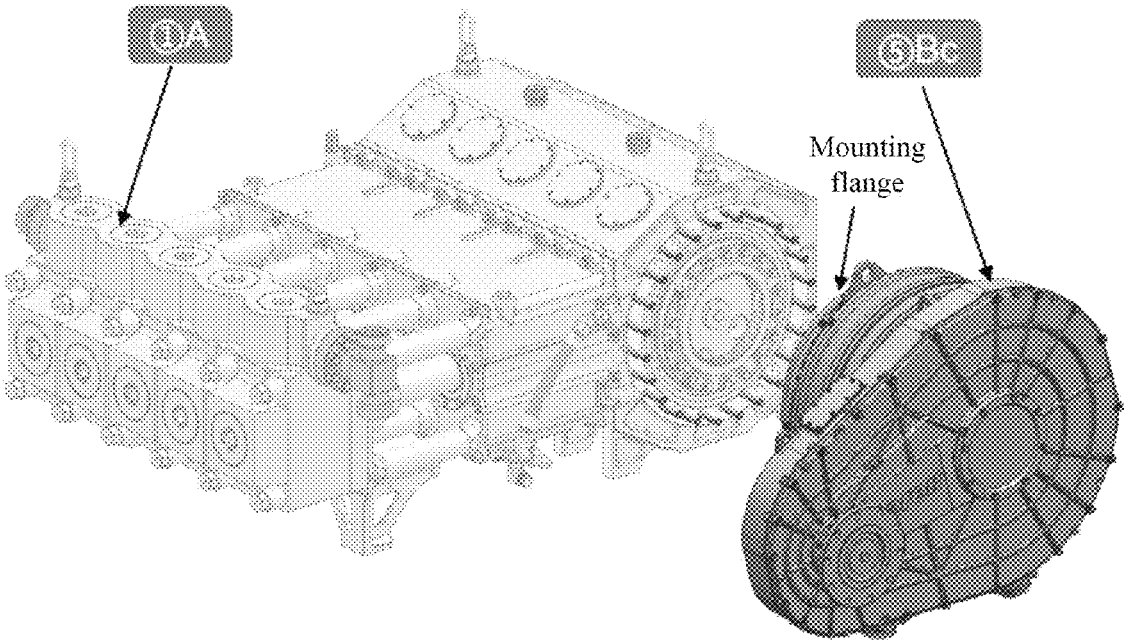

(11) As shown in FIG. 25, the reduction gearbox assembly ⑤ Bc is used for replacement.

Figure 26:
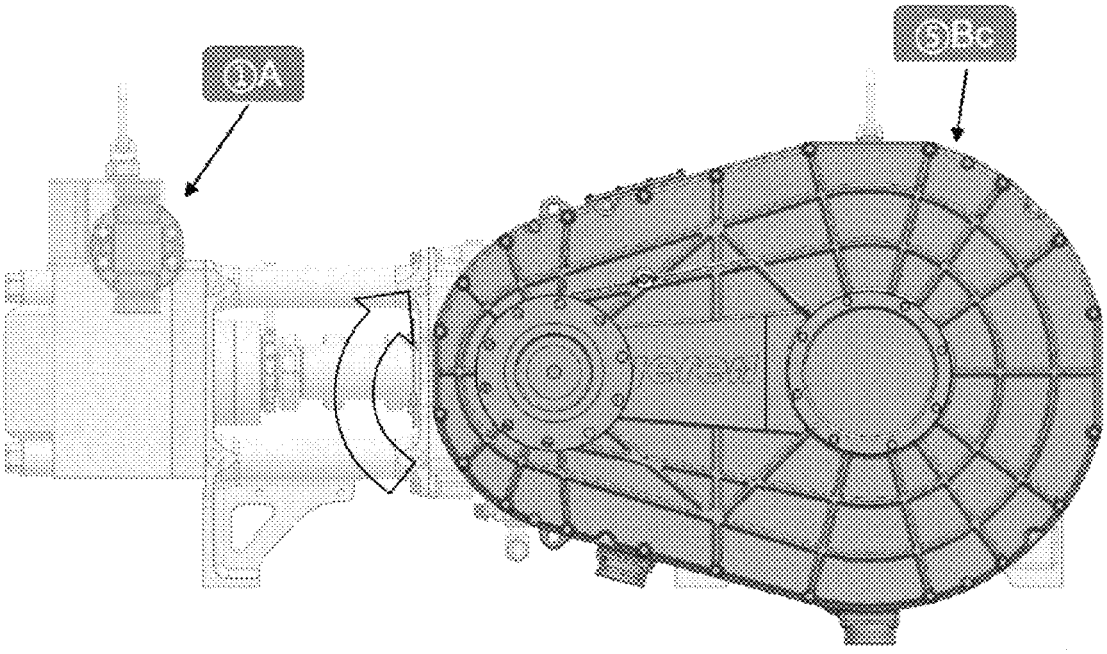
Figures 27A, 27B:
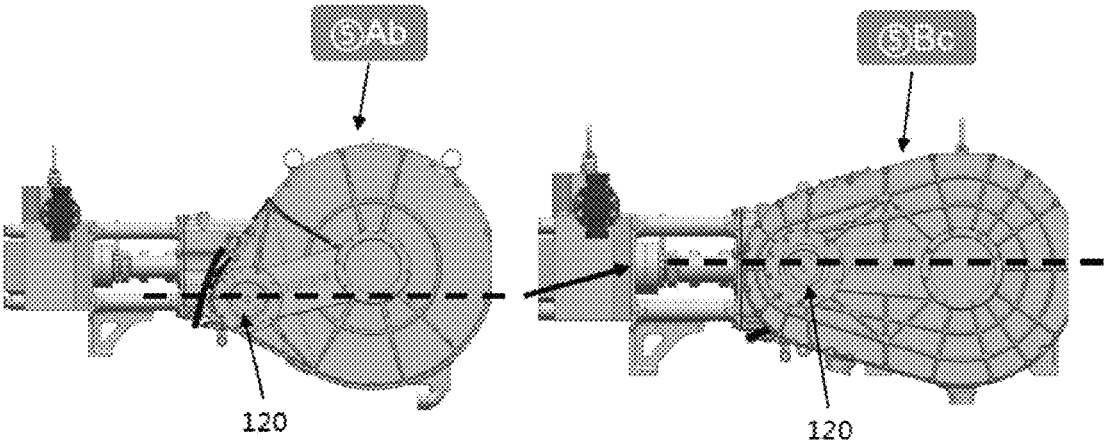

(12) Referring to FIG. 27A and FIG. 27B, because switching from Product 2 to Product 3 corresponds to changing from fuel engine drive to electric motor drive, it is necessary to adjust the height position of the connection flange 120 of the reduction gearbox assembly ⑤ Bc relative to that of the connection flange 120 of the reduction gearbox assembly ⑤ Ab based on the change in the adapted prime mover. Therefore, as shown in FIG. 26, the reduction gearbox assembly ⑤ Bc rotates in a clockwise direction by at least 1 of the positioning holes of the mounting flange (rotation by 1 hole corresponds, for example, to rotation by 15°). In this way, adjustment of the height position of the connection flange 120 of the reduction gearbox assembly ⑤ Bc is implemented.

Figure 28:
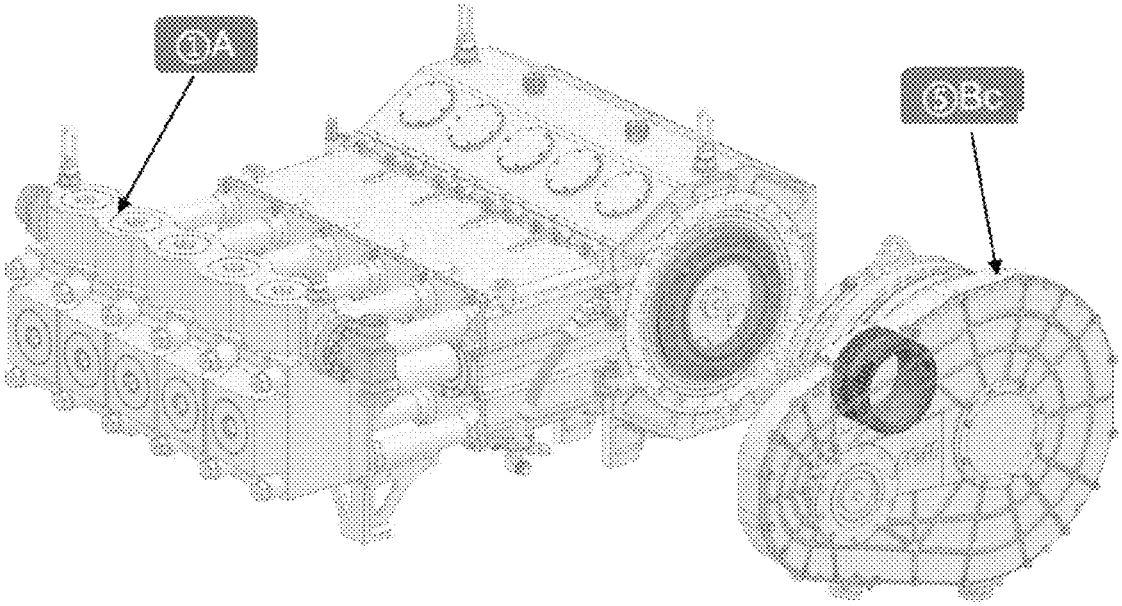
Figure 29:
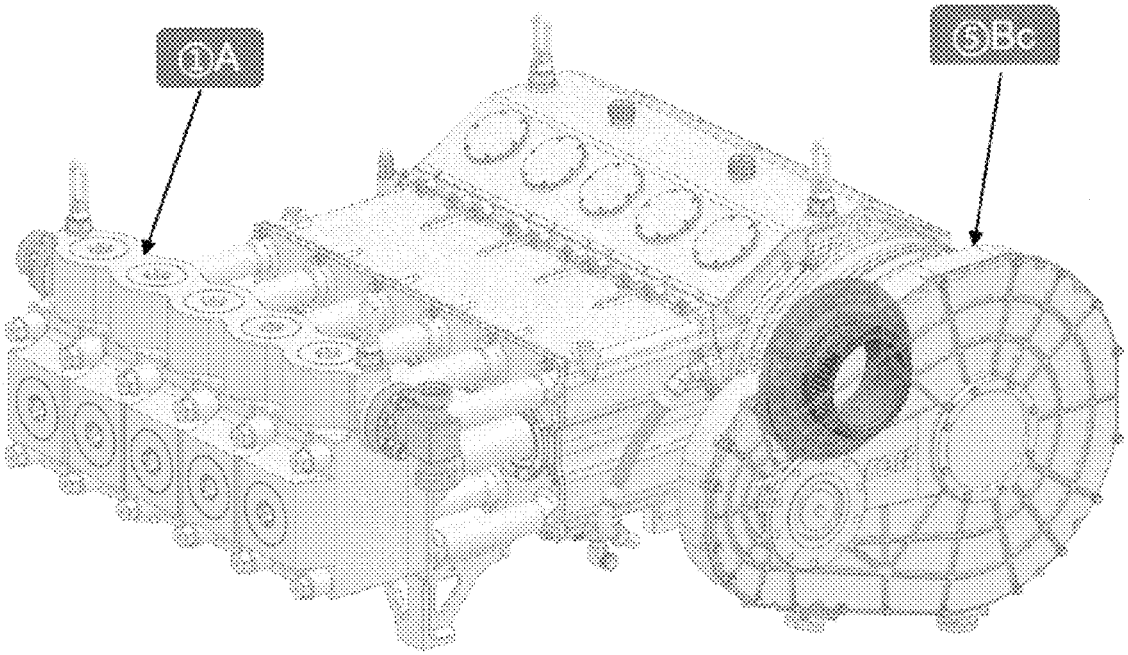

(13) As shown in FIG. 28 and FIG. 29, the external splines of the output crowned teeth (output shaft) inside the reduction gearbox assembly ⑤ Bc are aligned with the internal splines of the crankshaft input end of the crankcase assembly and then inserted. Additionally, the positioning holes on the second end of the mounting flange of the reduction gearbox assembly ⑤ Bc are fitted onto the double-ended studs at the input port of the crankcase assembly.

Figure 30:
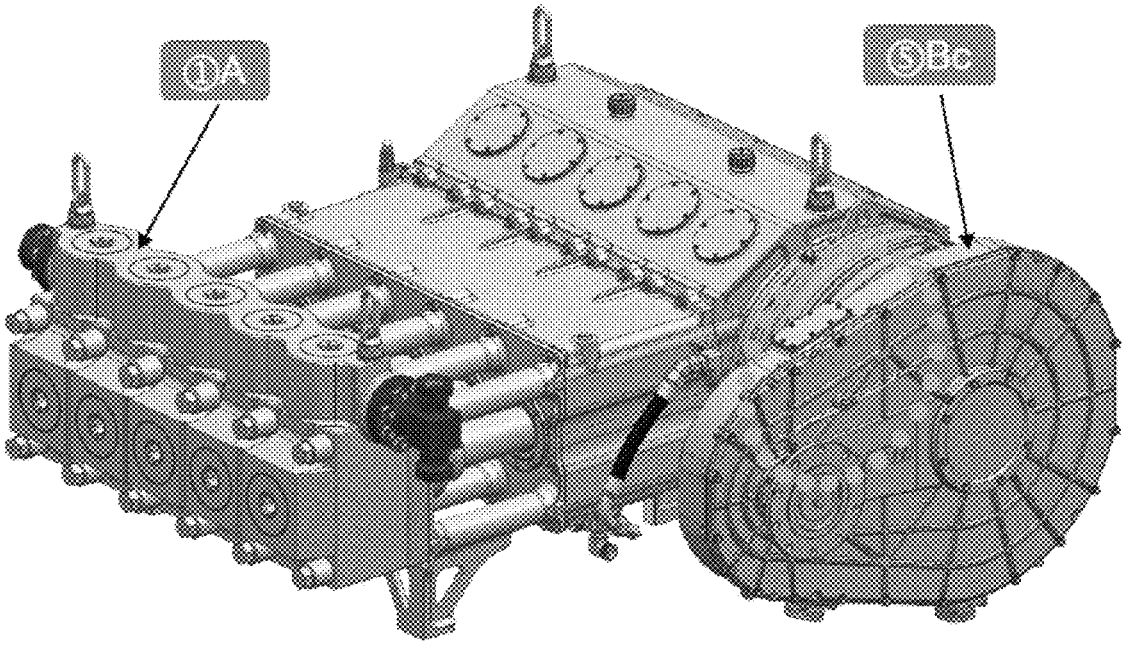

(14) As shown in FIG. 30, nuts in the circumferential direction are tightened at the second end of the mounting flange of the reduction gearbox assembly ⑤ Bc.

Figure 31:
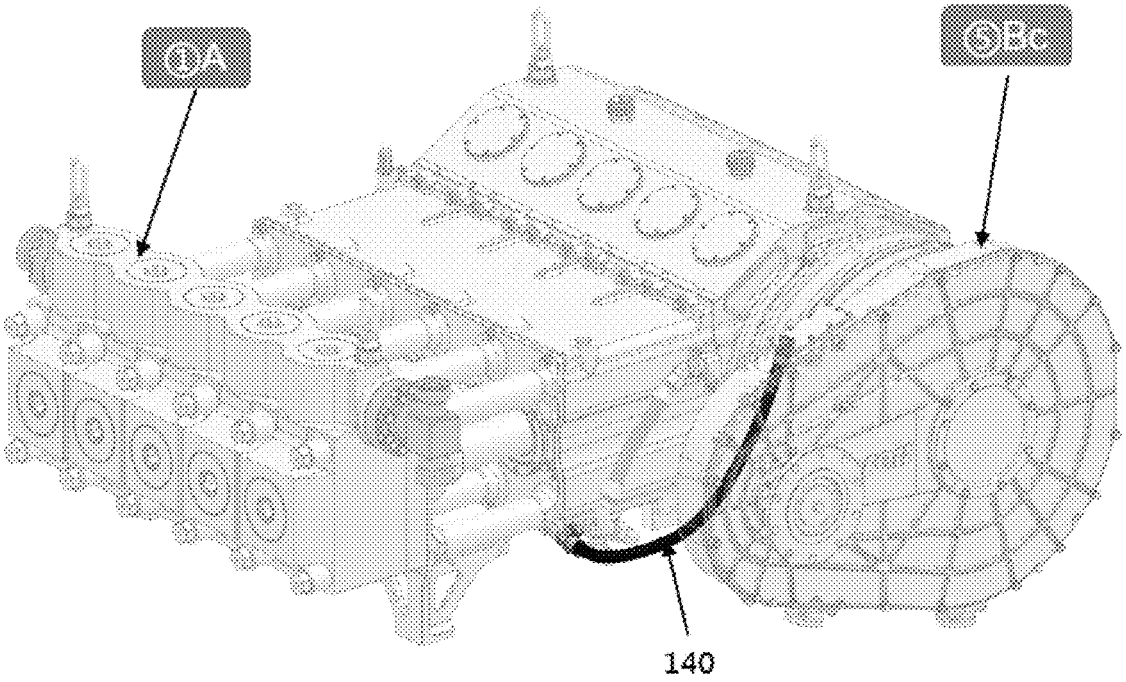

(15) As shown in FIG. 31, the lubricating oil supply pipe 140 is mounted on the reduction gearbox assembly ⑤ Bc. So far, replacing the reduction gearbox assembly ⑤ Ab with ⑤ Bc is completed, to obtain Product 3 shown in FIG. 16.

By using the foregoing steps (1) to (15), replacing Product 2 with Product 3 is completed.

In addition, when switching to other products, for instance, if the crosshead box assembly in the product is to be replaced, the fluid end assembly should first be detached as described up to the steps shown in FIG. 18B. Subsequently, the spacer frame assembly and the crosshead box assembly are sequentially detached. After the crosshead box assembly for replacement is mounted, the spacer frame assembly and the fluid end assembly are sequentially mounted.

The foregoing embodiments, alternatives, and various variants are only preferred embodiments of the present disclosure, but the protection scope of the present disclosure is not limited thereto. A person skilled in the art may, within the technical scope disclosed in the present disclosure, make any modification, replacement, or change according to the technical solutions of the present disclosure and their concepts, which shall fall within the protection scope of the present disclosure.

LIST OF REFERENCE NUMERALS

10: Split-type plunger pump; 100, 100*a*, 100*b*: First module; 110, 110*a*, 110*b*: Reduction gearbox assembly

115*a*, 115*b*: Reduction gearbox housing; 116*a*, 116*b*: Input shaft; 117*a*, 117*b*: Output shaft; 120: Connection flange

130, 130*a*, 130*b*: Mounting flange; 200: Second module; 210: Crankcase assembly; 211: Crankshaft; 212: Crankcase housing

216; Support base; 217: Front end surface; 219: Sealing ring; 300: Third module; 310: Crosshead box assembly; 311: Crosshead

312: Connecting rod; 313: Pull rod; 314: Crosshead box housing; 317: Rear end surface; 317': Front end surface; 319: Sealing ring

400: Fourth module; 410: Fluid end assembly; 421: Plunger; 422: Valve box;

426: Backplate; 427: Hoop

500: Fifth module; 510: Spacer frame assembly; 531: Support bracket; 532: Rear end surface; 532': Front end surface; 533: Spacer

600: Long bolt; 610: Fastening nut; LH: Bolt hole; XH: Pin hole; DH: Set screw hole; sH: Long bolt hole bH: Large through hole

What is claimed is:

1. A split-type plunger pump, comprising: a first module, comprising a reduction gearbox assembly, an input side interface of the first module being detachably connectable to engines or motors having transmission shafts with different height positions;

a second module, comprising a crankcase assembly, an input side interface of the second module being detachably connected to an output side interface of the first module;

a third module, comprising a crosshead box assembly, an input side interface of the third module being detachably connected to an output side interface of the second module; and a fourth module, comprising a fluid end assembly, an input side interface of the fourth module being detachably connected to an output side interface of the third module, wherein:

the reduction gearbox assembly, the crankcase assembly, the crosshead box assembly, and the fluid end assembly are sequentially connected, an input shaft of the reduction gearbox assembly is configured to receives power output from one of the transmission shafts of the engines or motors, and an output shaft of the reduction gearbox assembly outputs rotary power to a crankshaft of the crankcase assembly, the output side interface of the first module and/or the input side interface of the first module are configured in a platform-based manner, and when the reduction gearbox assembly and the crankcase assembly are assembled together, the reduction gearbox assembly is configured to be rotatable relative to the input side interface of the second module during mounting, such that a height position of the input side interface of the first module is aligned with a height position of the transmission shaft of a selected engine or motor.

2. The split-type plunger pump according to claim 1, wherein:

the output side interface of the first module comprises a mounting flange;

a first end of the mounting flange is connected to an output port on an output side connection surface of the reduction gearbox assembly, and a second end of the mounting flange is provided with positioning holes configured in a platform-based manner, to connect to an input port on an input side connection surface of the crankcase assembly via a bolt and a nut configured in a platform-based manner.

3. The split-type plunger pump according to claim 2, wherein:

the first end of the mounting flange is welded or integrally cast to the output port of the reduction gearbox assembly, or the first end of the mounting flange is provided with multiple positioning holes, to connect to the output port of the reduction gearbox assembly via multiple bolts and nuts, and the reduction gearbox assembly is able to rotate by at least one hole of the positioning holes on the first end of the mounting flange and/or at least one hole of the positioning holes on the second end of the mounting flange.

4. The split-type plunger pump according to claim 2, wherein:

the output shaft of the reduction gearbox assembly is provided with a spline configured in a platform-based manner, to connect to the crankshaft of the crankcase assembly.

5. The split-type plunger pump according to claim 1, wherein:

the input side interface of the first module comprises a connection flange, a first end of the connection flange is connected to an input port on an input side connection surface of the reduction gearbox assembly, and a second end of the connection flange is provided with positioning holes configured in a platform-based manner, to connect to an output port of the transmission shaft of the selected engine or motor via bolts and nuts configured in a platform-based manner.

6. The split-type plunger pump according to claim 5, wherein:

the first end of the connection flange is welded or integrally cast to the input port of the reduction gearbox assembly, or the first end of the connection flange is provided with multiple positioning holes to connect to the input port of the reduction gearbox assembly via multiple bolts and nuts.

7. The split-type plunger pump according to claim 1, wherein:

the output side interface of the second module and/or the input side interface of the second module are configured in a platform-based manner, and an input port on an input side connection surface of the crankcase assembly is provided with positioning holes configured in a platform-based manner, to connect to the output side interface of the first module via bolts and nuts configured in a platform-based manner, and the crankshaft of the crankcase assembly is provided with a spline configured in a platform-based manner, to connect to the output shaft of the reduction gearbox assembly.

8. The split-type plunger pump according to claim 1, wherein:

the output side interface of the second module and/or the input side interface of the second module are configured in a platform-based manner, and an output port on an output side connection surface of the crankcase assembly is provided with a pin hole and a bolt hole configured in a platform-based manner, to connect to the input side interface of the third module via a positioning pin and a bolt configured in a platform-based manner.

9. The split-type plunger pump according to claim 2, wherein:

the input port on the input side connection surface of the crankcase assembly is provided with positioning holes configured in a platform-based manner, to connect to the positioning holes configured in a platform-based manner on the second end of the mounting flange via the bolts and the nuts configured in a platform-based manner, and the crankshaft of the crankcase assembly is provided with a spline configured in a platform-based manner, to connect to the output shaft of the reduction gearbox assembly.

10. The split-type plunger pump according to claim 1, wherein:

the output side interface of the third module and/or the input side interface of the third module are configured in a platform-based manner; and an input port on an input side connection surface of the crosshead box assembly is provided with a pin hole and a bolt hole configured in a platform-based manner, to connect to the output side interface of the second module via a positioning pin and a bolt configured in a platform-based manner.

11. The split-type plunger pump according to claim 1, wherein:

the output side interface of the second module and/or the input side interface of the second module are configured in a platform-based manner, and an output port on an output side connection surface of the crosshead box assembly is provided with a pin hole and a bolt hole configured in a platform-based manner, to connect to the input side interface of the fourth module via a positioning pin and a bolt configured in a platform-based manner.

12. The split-type plunger pump according to claim 1, wherein:

the crosshead box assembly has a crosshead, one end of the crosshead is connected to the crankshaft of the crankcase assembly via a connecting rod, and the other end of the crosshead is connected to a plunger of the fluid end assembly directly or via a pull rod.

13. The split-type plunger pump according to claim 1, wherein:

the input side interface of the fourth module is configured in a platform-based manner, and an input side connection surface of the fluid end assembly is provided with a positioning pin and a bolt configured in a platform-based manner, to connect to the output side interface of the third module.

14. The split-type plunger pump according to claim 1, wherein:

the fluid end assembly, the crosshead box assembly, and the crankcase assembly are connected sequentially via a long bolt.

15. The split-type plunger pump according to claim 14, further comprising:

a fifth module, detachably connected between the output side interface of the third module and the input side interface of the fourth module and comprising a spacer frame assembly arranged between the crosshead box assembly and the fluid end assembly, wherein:

the fluid end assembly, the spacer frame assembly, the crosshead box assembly, and the crankcase assembly are tightly connected sequentially via the long bolt.

16. The split-type plunger pump according to claim 15, wherein:

an output side interface of the fifth module and/or an input side interface of the fifth module are configured in a platform-based manner; and an input side connection surface of the spacer frame assembly is provided with a pin hole and a bolt hole configured in a platform-based manner, to connect to the output side interface of the third module or the fourth module via a positioning pin and a bolt configured in a platform-based manner, respectively.

17. The split-type plunger pump according to claim 1, wherein:

a sealing apparatus configured in a platform-based manner is arranged between connection surfaces of the assemblies, and the sealing apparatus comprises a sealing ring arranged in a sealing groove on the connection surface.

18. A kit of components configured to be assembled into split-type plunger pumps, comprising:

a fluid end assembly with at least one specification;

a crosshead box assembly with at least one specification;

a crankcase assembly with at least one specification; and a reduction gearbox assembly with at least one specification, wherein:

the fluid end assembly has a first interface, the crosshead box assembly has a second interface and a third interface, and the second interface is detachably connected to the first interface, the crankcase assembly has a fourth interface and a fifth interface, and the fourth interface is detachably connected to the third interface, the reduction gearbox assembly has a sixth interface and a seventh interface, the sixth interface is detachably connected to the fifth interface via a mounting flange, and the seventh interface is detachably connectable to engines or motors having transmission shafts with different height positions, via a connection flange, the first interface to the seventh interface are configured in a platform-based manner, when the reduction gearbox assembly and the crankcase assembly are assembled together, the reduction gearbox assembly is configured to be rotatable relative to the fifth interface of the crankcase assembly during mounting, such that a height position of the seventh interface of the reduction gearbox assembly is aligned with a height position of a transmission shaft of a selected engine or motor, and any two or more of the fluid end assembly, the crosshead box assembly, the crankcase assembly, and the reduction gearbox assembly are configured to be combined according to their respective at least one specification to configure plunger pumps with different performance parameters.

19. The kit of components according to claim 18, wherein:

the reduction gearbox assembly with at least one specification has a single parallel- stage reduction structure or a parallel and planetary two-stage reduction structure, and/or the reduction gearbox assembly with at least one specification has different gear ratios.

20. The kit of components according to claim 18, further comprising:

a spacer frame assembly with at least one specification, wherein the spacer frame assembly is inserted between the fluid end assembly and the crosshead box assembly, wherein:

the spacer frame assembly has an eighth interface and a ninth interface, the eighth interface is detachably connected to the first interface, and the ninth interface is detachably connected to the second interface, the eighth interface and the ninth interface are configured in a platform-based manner, and any two or more of the fluid end assembly, the spacer frame assembly, the crosshead box assembly, the crankcase assembly, and the reduction gearbox assembly are configured to be combined according to their respective at least one specification to configure plunger pumps with different performance parameters.

* * * * *